US006072457A

United States Patent [19]

Hashimoto et al.

[11] Patent Number: 6,072,457

[45] **Date of Patent: *Jun. 6, 2000**

[54] DISPLAY AND ITS DRIVING METHOD

[75] Inventors: Seiji Hashimoto, Yokohama; Makoto Matsuura, Kanagawa; Kazuyuki Shigeta, Isehara, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/466,750

[22] Filed: Jun. 6, 1995

[30] Foreign Application Priority Data

Jun. 6, 1994 [JP] Japan ..... 6-123648
Jun. 2, 1995 [JP] Japan ..... 7-136853

[51] Int. Cl.[7] ..... G09G 3/36

[52] U.S. Cl. ..... 345/100; 345/96; 345/132

[58] Field of Search ..... 345/87, 98, 100, 345/74, 75, 138, 132, 96; 348/443, 458, 792

[56] References Cited

U.S. PATENT DOCUMENTS 5,172,249 12/1992 Hashimoto ..... 358/482
5,202,674 4/1993 Takemori et al. ..... 340/781
5,235,419 8/1993 Krause ..... 358/135
5,461,424 10/1995 Shimizu ..... 348/443
5,481,275 1/1996 Mical et al. ..... 345/132
5,648,793 7/1997 Chen ..... 345/96

FOREIGN PATENT DOCUMENTS 0408347 1/1991 European Pat. Off. .
3836558 5/1990 Germany .
2182087 7/1990 Japan .
537909 2/1993 Japan .
5100641 4/1993 Japan .
5236435 9/1993 Japan .

*Primary Examiner*—Steven J. Saras
*Assistant Examiner*—Amr Awad
*Attorney, Agent, or Firm*—Fitzpatrick, Cella, Harper & Scinto

[57] ABSTRACT

A display and its driving method is provided in which the image signal can be input into a panel having a smaller number of rows than the number of scan lines for the image signal, without producing image distortion. For example, a signal of the PAL system having more rows is displayed on a display for the NTSC having less rows. The signal control is made such that an image signal is written in two rows at every horizontal scan, except for a particular image signal, but the particular image signal is written in one row. Normally, the image signal for every horizontal scan is written in two rows, but only a particular image signal for every horizontal scan is compressed and displayed in one row. Accordingly, the vertical resolution is not degraded, unlike the scan for thinning out the image signal.

48 Claims, 30 Drawing Sheets

| ROW | DISPLAY SIGNAL | | | | | |
|---|---|---|---|---|---|---|
| | ODD FIELD | | | EVEN FIELD | | |
| | IMAGE SIGNAL | LINE MEMORY 1 | LINE MEMORY 2 | IMAGE SIGNAL | LINE MEMORY 1 | LINE MEMORY 2 |
| L1 | o1 | A- | | e1 | A+ | |
| L2 | | | B+ | e2 | | B- |
| L3 | o2 | A- | | | A+ | |
| L4 | | | B+ | e3 | | B- |
| L5 | o3 | A- | △ | | A+ | |
| L6 | o4 | | B+ | e4 | △ | B- |
| L7 | | A- | | e5 | A+ | |
| L8 | o5 | | B+ | | | B- |
| L9 | | A- | | e6 | A+ | |
| L10 | o6 | | B+ | | | B- |
| L11 | | A- | | e7 | A+ | |
| L12 | o7 | △ | B+ | | | B- |
| L13 | o8 | A- | | e8 | A+ | △ |
| L14 | | | B+ | e9 | | B- |
| ⋮ | | | | | A+ | |

A, B: SAMPLING PHASE  -, +: SIGNAL INVERSION POLARITY

FIG. 4

| ROW | DISPLAY SIGNAL | | | | | |
|---|---|---|---|---|---|---|
| | ODD FIELD | | | EVEN FIELD | | |
| | IMAGE SIGNAL | LINE MEMORY 1 | LINE MEMORY 2 | IMAGE SIGNAL | LINE MEMORY 1 | LINE MEMORY 2 |
| L1 | o1 | A- | | e1 | A+ | |
| L2 | | | B+ | e2 | | B- |
| L3 | o2 | A- | | | A+ | |
| L4 | | | B+ | e3 | | B- |
| L5 | o3 | A- | △ | | A+ | |
| L6 | o4 | | B+ | e4 | △ | B- |
| L7 | | A- | | e5 | A+ | |
| L8 | o5 | | B+ | | | B- |
| L9 | | A- | | e6 | A+ | |
| L10 | o6 | | B+ | | | B- |
| L11 | | A- | | e7 | A+ | |
| L12 | o7 | △ | B+ | | | B- |
| L13 | o8 | A- | | e8 | A+ | △ |
| L14 | | | B+ | e9 | | B- |
| ⋮ | | | | | A+ | |

A, B: SAMPLING PHASE  -, +: SIGNAL INVERSION POLARITY

FIG. 10

| ROW | DISPLAY SIGNAL | | |
|---|---|---|---|
| | ODD FIELD | | |
| | IMAGE SIGNAL | LINE MEMORY 1 | LINE MEMORY 2 |
| $L_1$ | 01 | A- | |
| $L_2$ | | | B+ |
| $L_3$ | 02 | | A- |
| $L_4$ | | B+ | |
| $L_5$ | 03 | A- | △ |
| $L_6$ | 04 | B+ | |
| $L_7$ | | | A- |
| $L_8$ | 05 | | B+ |
| $L_9$ | | A- | |
| $L_{10}$ | 06 | B+ | |
| $L_{11}$ | | | A- |
| $L_{12}$ | 07 | △ | B+ |
| $L_{13}$ | 08 | | A- |
| $L_{14}$ | | B+ | |

FIG. 11

| ROW | DISPLAY SIGNAL | | |
|---|---|---|---|
| | ODD FIELD | | |
| | IMAGE SIGNAL | LINE MEMORY 1 | LINE MEMORY 2 |
| $L_1$ | 01 | A+ | |
| $L_2$ | | | B+ |
| $L_3$ | 02 | A- | |
| $L_4$ | | | B- |
| $L_5$ | 03 | A+ | △ |
| $L_6$ | 04 | | B+ |
| $L_7$ | | A- | |
| $L_8$ | 05 | | B- |
| $L_9$ | | A+ | |
| $L_{10}$ | 06 | | B+ |
| $L_{11}$ | | A- | |
| $L_{12}$ | 07 | △ | B- |
| $L_{13}$ | 08 | A+ | |
| $L_{14}$ | | | B+ |

| | 1st FIELD | 2nd FIELD |
|---|---|---|
| ⋮ | ⋮ | ⋮ |
| 2(k-1) ROW | $O_{k-2}$ | $E_{k-1}$ |
| 2k-1 ROW | $O'_{k-1}$ | $E'_{k-1}$ |
| 2k ROW | $O_{k-1}$ | $E_k$ |
| 2(k+1)-1 ROW | $O'_k$ | $E'_k$ |
| 2(k+1) ROW | $O_k$ | $E_{k+1}$ |
| ⋮ | ⋮ | ⋮ |

| | 1st FIELD | 2nd FIELD | 3rd FIELD | 4th FIELD |
|---|---|---|---|---|
| 2n ROW | $O_{n-1}$ (1) | $E_n$ (1) | $O_{n-1}$ (2) | $E_n$ (2) |
| 2n+1 ROW | $O_n$· (1) | $E_n$· (1) | $O_n$· (2) | $E_n$· (2) |
| 2(n+1) ROW | $O_n$ (1) | $E_{n+1}$ (1) | $O_n$ (2) | $E_{n+1}$ (2) |
| 2n+3 ROW | $O_{n+1}$· (1) | $E_{n+1}$· (1) | $O_{n+1}$· (2) | $E_{n+1}$· (2) |
| 2(n+2) ROW | $O_{n+1}$ (1) | $E_{n+2}$ (1) | $O_{n+1}$ (2) | $E_{n+2}$ (2) |

FIG. 34

| ROW | IMAGE SIGNAL | |
|---|---|---|
| | ODD FIELD | EVEN FIELD |
| L1 | o1 - | e1 + |
| L2 | o2 + | e2 - |
| L3 | o3 - | e3 + |
| L4 | o4 + | e4 - |
| L5 | o5 - | e5 + |
| L6 | o6 + | e6 - |
| L7 | △ o8 - | e7 + |
| L8 | o9 + | e8 - |
| L9 | o10 - | △ e10 + |
| ⋮ | ⋮ | ⋮ |

DISPLAY AND ITS DRIVING METHOD

BACKGROUND OF THE INVENTION

1. Field of the Invention

The present invention relates to a display and its driving method, and more particularly to a display and its driving method for inputting image signals of various standards into the panel having only a predefined number of rows.

2. Background Art

Recently, thin type flat displays as a computer to human interface, in place of CRT (Cathode Ray Tube), have become an important device to extend the multi-media market. As the flat display, an LCD (Liquid Crystal Display), a PDP (Plasma Display) and an electron beam flat display have become widely accepted. Particularly, the liquid crystal display has gained a large market along with the spread of small-sized personal computers. Among the types of liquid crystal displays, the active matrix liquid crystal display achieves greater contrast over the whole screen because of the absence of crosstalk, as compared with a simple matrix liquid crystal display such as STN. Therefore, the active matrix liquid crystal display has drawn the public's attention not only as the display for small personal computers, but also as the view finder for video cameras, projectors, and thin type televisions.

The active matrix liquid crystal display is classified into TFT and diode types. FIG. 33A is a block diagram of the image signal input for TFT image display. 20 is a display pixel unit having pixels arranged in a matrix, 40 is a vertical scan circuit for selecting the display row, 30 is a sampling circuit for color image signal, and 80 is a horizontal scan circuit for outputting the sampling signal.

A unit pixel of the display pixel unit 20 is composed of a switching element 11, a liquid crystal material 15, and a pixel capacitor 12. When the switching element 11 is a TFT (thin film transistor), a gate line 13 connects the gate electrode of the TFT to the vertical scan circuit 40, one terminal of pixel capacitor 12 for each of all the pixels being connected commonly to a common electrode 21 of an opposed substrate, to which a common electrode voltage $V_{LC}$ is applied. When the switching element 11 is a diode (including Metal/Insulator/Metal element), the scan electrode runs transversely across the opposed substrate to connect to the vertical scan circuit 20. An input terminal of the switching element 11 is connected by a vertical data line to the sampling circuit 30. Whether TFT or diode, a vertical data line 14 connects the input terminal of the switching element 14 to the sampling circuit 30, and an output terminal of the switching element 14 is connected to the other terminal of the pixel capacitor 12.

A control circuit 140 separates an image signal into necessary signals for the vertical scan circuit 40, the horizontal scan circuit 80 or a signal processing circuit 120. The signal processing circuit 120 performs a gamma processing in view of the liquid crystal characteristics, or an inversion signal processing for longer life of the liquid crystal to output a color image signal (red, blue, green) to the sampling circuit 30.

FIG. 33B is a detail equivalent circuit diagram of the display pixel unit 20 and the sampling circuit 30 for TFT color. 10 is a unit pixel for each color. The pixels (R, G, B) are arranged in delta configuration, the same color being allocated on either side of the data line 14 (d1, d2, . . . ) for every row, and connected to the data line 14 (d1, d2, . . . ). The sampling circuit 30 is comprised of switching transistors (sw1, sw2, . . . ) and capacitors (parasitic capacitor and pixel capacitor of the data line 14). An image signal input line 16 is comprised of a signal line dedicated for each color of RGB. The switching transistors (sw1, sw2, . . . ) sample each color signal from the image signal input line 16 in accordance with a pulse (ϕh1, ϕh2, . . . ) from the horizontal scan circuit 80, and transfer each color signal to each pixel through the data line 14 (d1, d2, . . . ). And they send pulses (ϕg1, ϕg2, . . . ) from the vertical scan circuit 40 to the TFT gate of pixels, and write a signal into each pixel by selecting the row. In this way, the pulse (ϕg1, ϕg2, . . . ) turns on the TFT 11 contained in each row, so that the image signal for one horizontal scan in each corresponding row is written into all pixels contained in each row. It is noted that the image signal for one horizontal scan is thereafter referred to as 1H signal.

The liquid crystal display displays a television signal or a personal computer signal. However, there are a variety of standards for these signals, whereby it is necessary to normally fabricate the panel for liquid crystal display of the type that conforms to the respective standard utilized. On the other hand, there exists a liquid crystal display for displaying the signal of various standards on one panel through appropriate signal processing. For example, a liquid crystal display is provided which displays the image of PAL (Phase Alternation by Line) system having more scan lines than the NTSC (National Television System Committee) system on the panel only having the rows corresponding to the number of scan lines in the NTSC system. Such display examples were disclosed in Japanese Laid-Open Patent Application No. 2-182087 or Japanese Laid-Open Patent Application No. 5-37909. In these publications, processing for thinning out some 1H signals from the image signal according to the PAL system is adopted. Specifically, in order to transform the effective number of scan lines (280) for one field in the PAL system into the 240 lines of the NTSC system, the image signal is thinned out at a rate of 1 line for every 7 lines. FIG. 9 represents a specific example of this thinning out method. The image signal of the PAL system is written on a liquid crystal display only having the rows for one field (i.e., half rows of one frame) of the NTSC system. If the image signal of NTSC system is input, 1H signal o1, o2, . . . for odd field, or 1H signal e1, e2, . . . for even field is written sequentially into each row (L1, L2, . . . ) for the liquid crystal display. If the image signal of PAL system is input, the thinning out processing is performed, because there are more scan lines than the NTSC system. As an enable circuit erases a write instruction into the row (L9) upon a horizontal gate pulse which the vertical scan circuit outputs, 1H signal o7 (e9) is thinned out. And as 1H signal o7 (e10) is written for the next 1H period, 1H signal o7 (e9) is not displayed. Δ indicates a 1H signal which is thinned out. Beside, there are two-row simultaneous driving in which 1H signal is written into adjacent two rows on a panel having the rows of two field (i.e., one frame), and accordingly two-row interpolation driving. In this case, like the signal input onto the panel only having the rows for one field, the image signal of the standard of having more scan lines than one frame of the panel is displayed by completely thinning out particular 1H signals.

In the display as described above, there is a drawback that because 1H signal is completely thinned out, the image is distorted so that the character or fine line of image in the vertical direction on the screen is not displayed, particularly that the contour is less visible. To overcome this drawback of image distortion, there is disclosed a system in Japanese Laid-Open Patent Application No. 5-236453. This system once writes the image signal of interlace system into the memory for the conversion into the image signal of non-interlace system. And image distortion is moderated by thinning out only one row, instead of thinning out two rows conventionally. Also, the similar method was disclosed in Japanese Laid-Open Patent Application No. 5-100641.

On the other hand, when the image signal is input into the liquid crystal display, it is common that the image signal is made the alternating current to prevent the burning of liquid crystal material. Also, if the spatial distribution and the temporal distribution of the panel is observed microscopically, the central voltage is preferably 0. Namely, it is preferable that adjacent rows are reversely polarized, and the polarity in the same row is reversed in a short time. This is true with a plasma display and an electron beam flat display in which if deflected signal voltage is input for long time, the electrode is corroded and the element is deteriorated. In this respect, because Japanese Laid-Open Patent Application No. 5-236435 as above cited does not consider the image signal that is made the alternating current, the image signal of the same polarity succeeds in the row direction by making the scanning for thinning out, resulting in a possibility that if taking notice of three rows, the central voltage of the image signal will greatly deviate from 0. Also, the above-mentioned No. 5-100641 discloses a method of inputting the image signal having a different polarity for each row, but this method requires a large amount of memory, resulting in a complicated circuit. Thus, the present invention has a subject to provide a display capable of displaying the image signal of various standards while reducing image distortion associated with the scan for thinning out as much as possible, thereby inputting reversely the image signal optimally, only with the addition of a simple circuit.

SUMMARY OF THE INVENTION

The present inventors have achieved the following invention, as a result of assiduous efforts to accomplish the above subject. That is, a display according to the present invention has a plurality of pixels arranged in a matrix, having a panel with the number of rows being m, and writing on said m rows the image signal constituting one field by the k horizontal scans ($k \neq m$ and $k \neq m/2$), while sequentially selecting the row, characterized by comprising vertical scan altering means for writing all the image signal corresponding to said k horizontal scans into respective rows of said m rows, within one field, and altering the number of rows to write the image signal corresponding to any horizontal scan. Also, the present invention encompasses an invention of the driving method of display. That is, a driving method for a display according to the present invention having a plurality of pixels arranged in a matrix, and having a panel with the number of rows being m, includes writing on the m rows the image signal constituting one field by the k horizontal scans ($k \neq m$ and $k \neq m/2$), while sequentially selecting the row, characterized in that vertical scan altering means writes all the image signal corresponding to said k horizontal scans into respective rows of said m rows, within one field, and alters the number of rows to write the image signal corresponding to any horizontal scan.

FIG. 1 shows an interlace circuit which is a portion of vertical scan altering means according to the present invention. 1 is a first control line, 2 is a second control line, 3 is a third control line, 1-1, 1-2, 1-3 is a first group of switches, 2-1, 2-2, 2-3 is a second group of switches, and 3-1, 3-2, 3-3 is a third group of switches. m1, m3, m5 is a line leading to a vertical scan circuit. By sending an appropriate pulse to the first control line connecting to the first group of switches, the second control line connecting to the second group of switches, and the third control line connecting to the third group of switches, the selection of row can be changed. Also, it is desirable to use a MOS transistor as the switch. The vertical scan circuit should be a bootstrap scan circuit. If the image signal constituting one frame by m horizontal scans is of the NTSC system, m is from 480 to 525. If the image signal constituting one field by k (k, m) horizontal scans to input the image is of the PAL system, k is from 250 to 313. Image signal input means normally writes the image signal corresponding to one horizontal scan, among k horizontal scans as above cited, into two rows, and only at every arbitrary n-th ($n \leqq k$) horizontal scan, writes the image signal corresponding to said n-th horizontal scan into any one row among said m rows. This value of n is desirably from 2 to 8, and more desirably from 3 to 4. The present invention is not limited to the NTSC system or PAL system, but also maybe used with image signals various standards. For example, VGA (Video Graphic Array; the number of rows 480), SVGA (Super Video Graphic Array; the number of rows 600), XGA (Xtended Graphics Array; the number of rows 768) and EWS (Engineering Work Station; the number of rows 1024) are acceptable.

The present invention can deal with any display as far as it is of the type sequentially scanning a multiplicity of rows by a scan circuit. Examples of the display of such type include a liquid crystal display, a plasma display, an electron beam flat display, an electroluminescence display and a multiluminous diode display. Among them, the present invention has a significant advantage over the small-sized portable display because of the capability of displaying the image signal of various standards. Among the liquid crystal display, plasma display, and electron beam display, the liquid crystal display is the most portable, and it is most beneficial to apply the present invention to the liquid crystal display. This liquid crystal display is either of the active matrix type and the simple matrix type. However, it is an active matrix type liquid crystal display that allows the interpolation driving of multiple rows, for one data line, while connecting a plurality of pixels that are offset in the horizontal direction due to delta arrangement. For example, an example 1 as hereinafter described is illustrative thereof. A two-row simultaneous driving may be applied to both the simple matrix and the active matrix. The active matrix type liquid crystal display may be of two terminal type (MIM type), or three terminal type (TFT type).

Normally, 1H signal is displayed in multiple rows (the number of simultaneously selected rows is assumed p), but some 1H signal is displayed only in q ($<p$) rows when displayed. Especially, 1H signal is written into two rows, but certain 1H signal is written in only one row. Hence, even if the signal having necessary more rows (as with the PAL system) is input into a display only having less rows (as with the NTSC system), there is no 1H signal to completely thin out. In this way, a display manufactured in the NTSC system can be made a display in the PAL system, and a display manufactured for the PAL can be made a display for the NTSC system. Therefore, it is possible to display the image signal of various standards on a single display. Also, the inversion input of image signal optimal for the panel can be effected only by the addition of a simple circuit.

BRIEF DESCRIPTION OF THE DRAWINGS

FIG. 4 is a chart showing the phase and polarity of image signal for each row on a panel.

FIG. 10 is a chart showing the phase and polarity of image signal for each row on a panel in an example 2.

FIG. 11 is a chart showing the phase and polarity of image signal for each row on a panel in an example 3.

FIG. 34 is a chart showing the polarity of image signal for each row on a conventional panel.

DETAILED DESCRIPTION OF THE PREFERRED EMBODIMENTS

Figure 2:
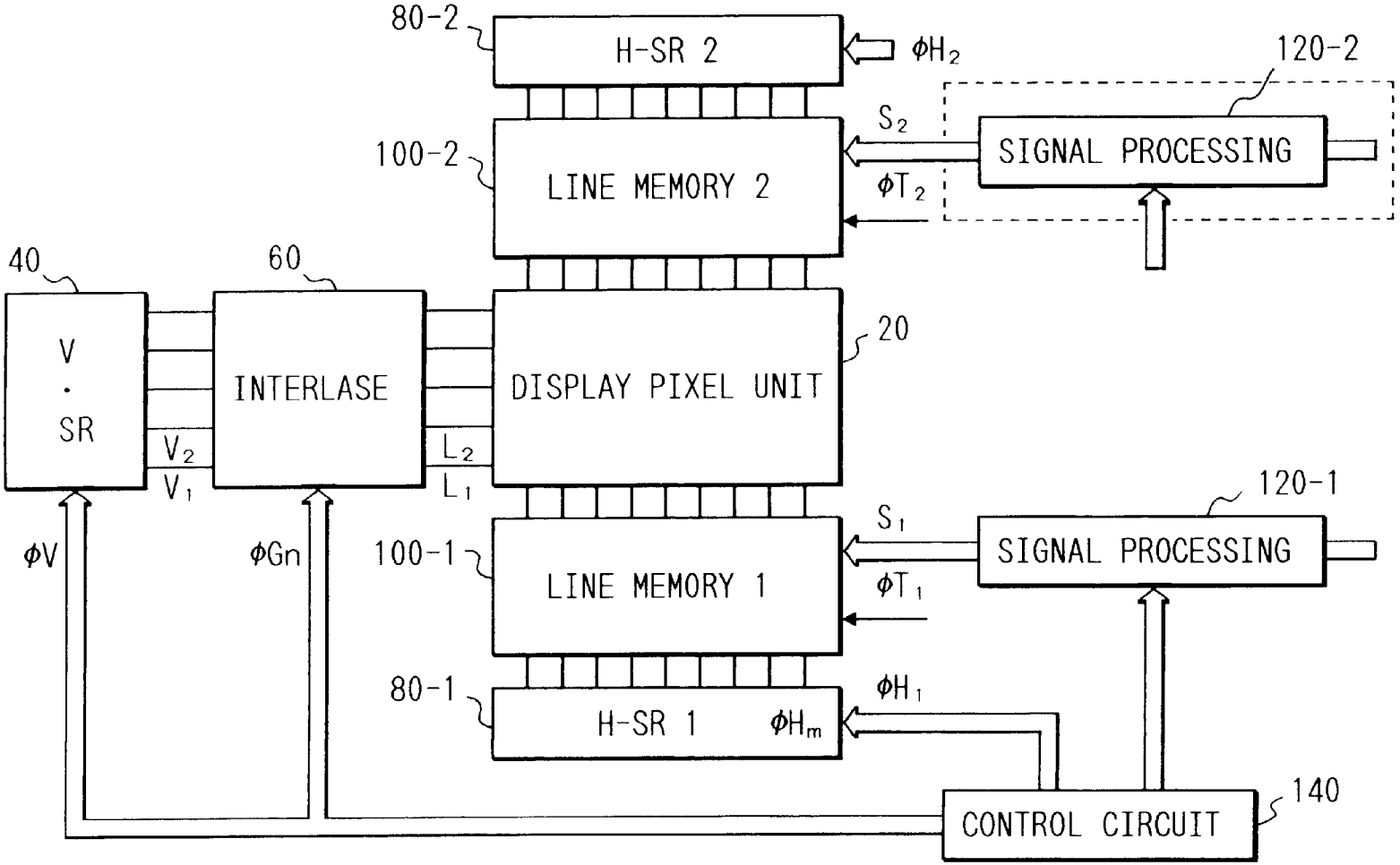
FIG. 2 is a block diagram showing the flow of image signal in an example 1.

An example 1 is one in which the present invention is applied to the two-row interpolation driving which is effective for the pixels in delta arrangement. The two-row interpolation driving has two image input circuits. FIG. 2 is a block diagram showing the flow of image signal in this example. In the figure, 20 is a display pixel unit, 40 is a vertical scan circuit of the display pixel unit, 60 is an interlace circuit for row selection, 80-1, 80-2 are horizontal scan circuits for display pixel unit, 100-1, 100-2 are line memories for temporarily storing the image signal sampled, 120-1, 120-2 are signal processing circuits for gamma processing of image signal of inversion signal processing for electrical polarity to drive the liquid crystal, and 140 is a control circuit for driving the display device. $S_1$ and $S_2$ represent image signals which have undergone signal processing in different signal processing circuits 120-1, 120-2, respectively. Herein, the first image input circuit contains 80-1, 100-1, 120-1, and the second image input circuit contains 80-2, 100-2, 120-2.

Figure 3:
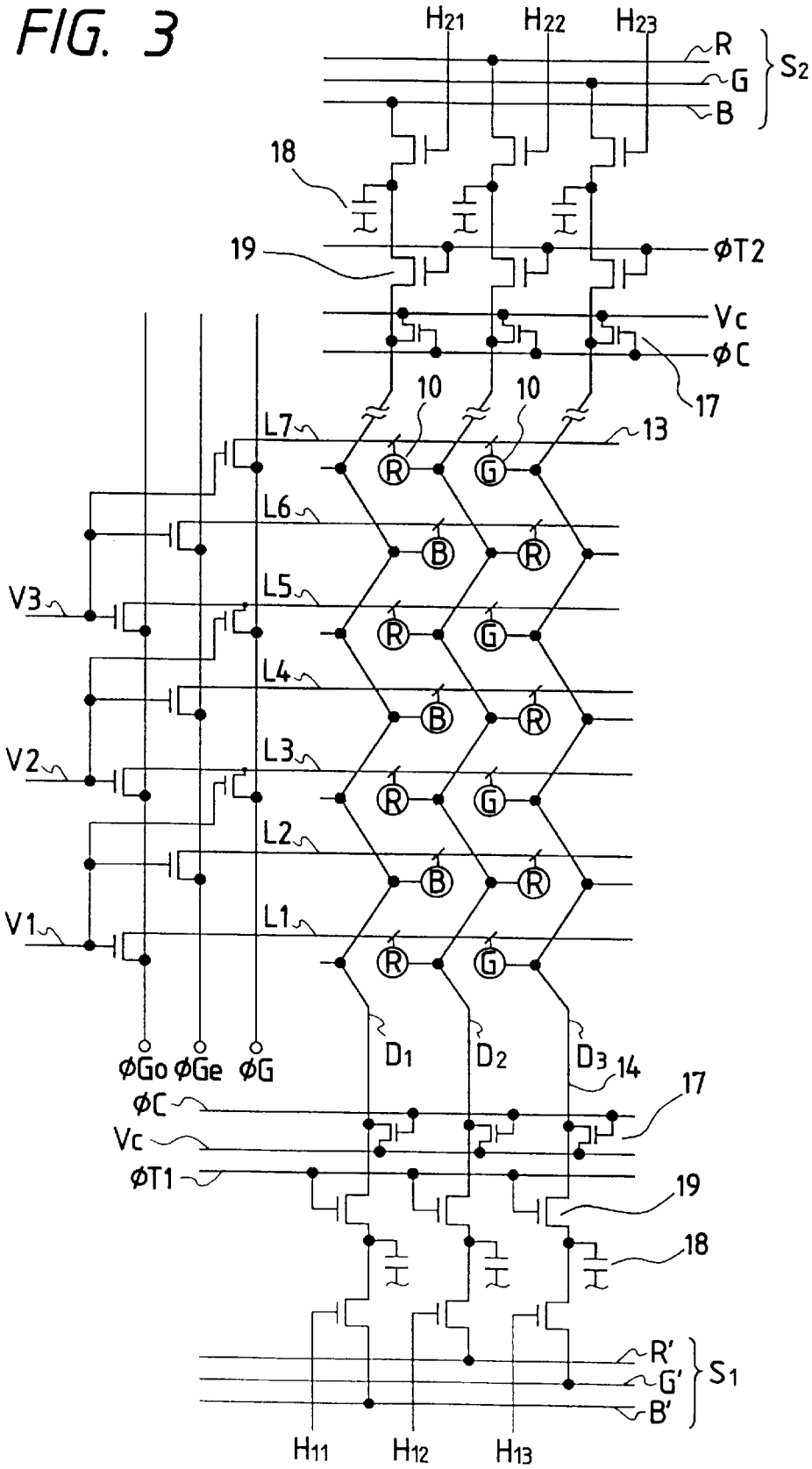
FIG. 3 is a detail view of an interlace circuit and a line memory.

FIG. 3 is a detail circuit diagram of the interlace circuit 60, the display pixel unit 20, and the line memories 100-1, 100-2. In the figure, 10 is a unit pixel consisting of a switching element, a liquid crystal and a color filter, $D_1$ to $D_n$ are vertical signal lines (data lines), $V_1$ to $V_2$ are signal lines from the vertical scan circuit, and $L_1$ to $L_n$ are horizontal gate lines for the row selection. Also, 17 is a reset transistor, 18 is a temporary storage capacitor, and 19 is a switching transistor.

For example, if the V1 pulse gets H, a transistor connecting thereto conducts, so that the row selection can be arbitrarily made from three rows in terms of interlace pulses (or vertical selection pulses) ϕG, ϕGo, ϕGe. Accordingly, the interlace circuit allows for various drivings including the interlace, two-line simultaneous field row shift, and non-interlace.

FIG. 4 is a chart showing the image signal to be written into the pixel in the example 1. The panel row is indicated by L1, L2, . . . , and the image signal to be written into corresponding row is indicated by o1, o2, . . . in the odd field and e1, e2, . . . in the even field for every 1H. At this time, the sampling phase of the signal to be written in each row pixel is indicated by A and B, and the inversion signal polarity is indicated by − and +. This sampling phase indicates a difference in the sampling timing.

Figure 7:
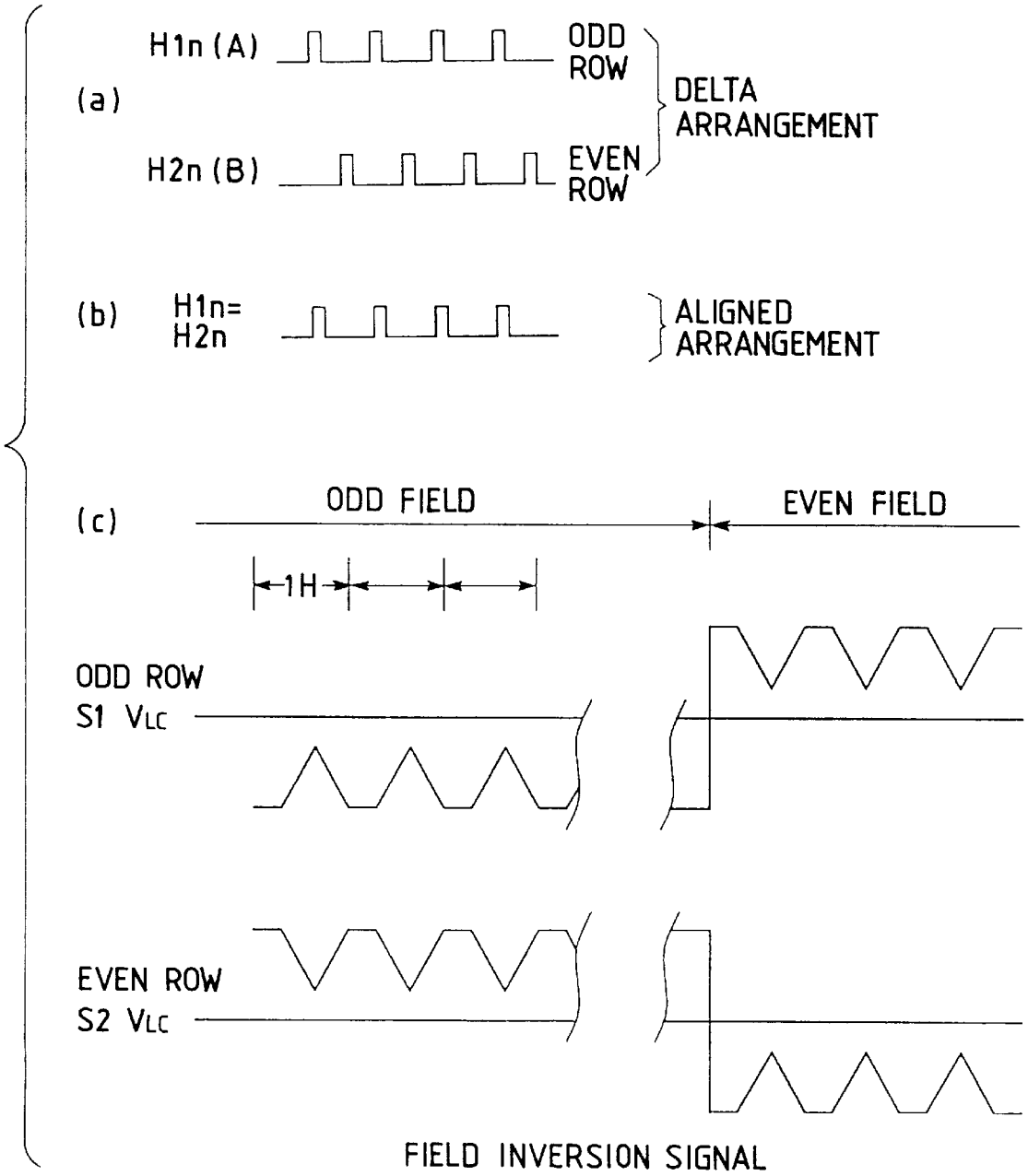
FIG. 7 represents (a) sampling pulse in delta arrangement, (b) sampling pulse in aligned arrangement, and (c) inversion image signal.

FIG. 7 represents the sampling pulse from the shift register (80-1, 80-2) in (a) delta arrangement and (b) aligned arrangement.

As shown in FIG. 3, in a delta arrangement in which each color of R, G and B is shifted by 1.5 pixels between adjacent rows, to improve the horizontal resolution, it is necessary to change the sampling pulse phase by 180° for every row (a) in FIG. 7. Also, by changing the inversion signal polarity for every row, it is possible to reduce the flicker. Thus, if the sampling phase and the polarity of inversion signal for each image signal in a line memory 1 and a line memory 2 are made as shown in FIG. 3, the above object can be accomplished.

The writing of image signal in this example will be described in FIG. 4. An image signal A is sampled at the timing indicated by $H_{1n}$(A), and an image signal B is sampled at the timing indicated by $H_{2n}$(B) in (a) in FIG. 7. When writing image signal o1, o2, each 1H signal is alternately written by changing the sampling phase (e.g., a signal o1 at 1H is written on a row $L_1$ as o1A−, and on a row $L_2$ as o1B+). And during image compression to write an image signal o3, only one of 1H signal is written (a signal o3 at 3H is written on a row pixel $L_5$ as o3A−), but the other is not written (o3B+). The not written image signal is indicated by Δ. As a result, the image in the vertical direction is compressed. In this way, because o3 signal is not thinned out, the vertical resolution is not degraded. The next 4H signal is written as o4B+ on a row $L_6$ and o4A− on a row $L_7$ by the interlace circuit. Such normal driving and compression driving operation is performed for every several Hs in both the odd field and the even field.

Figure 5A:
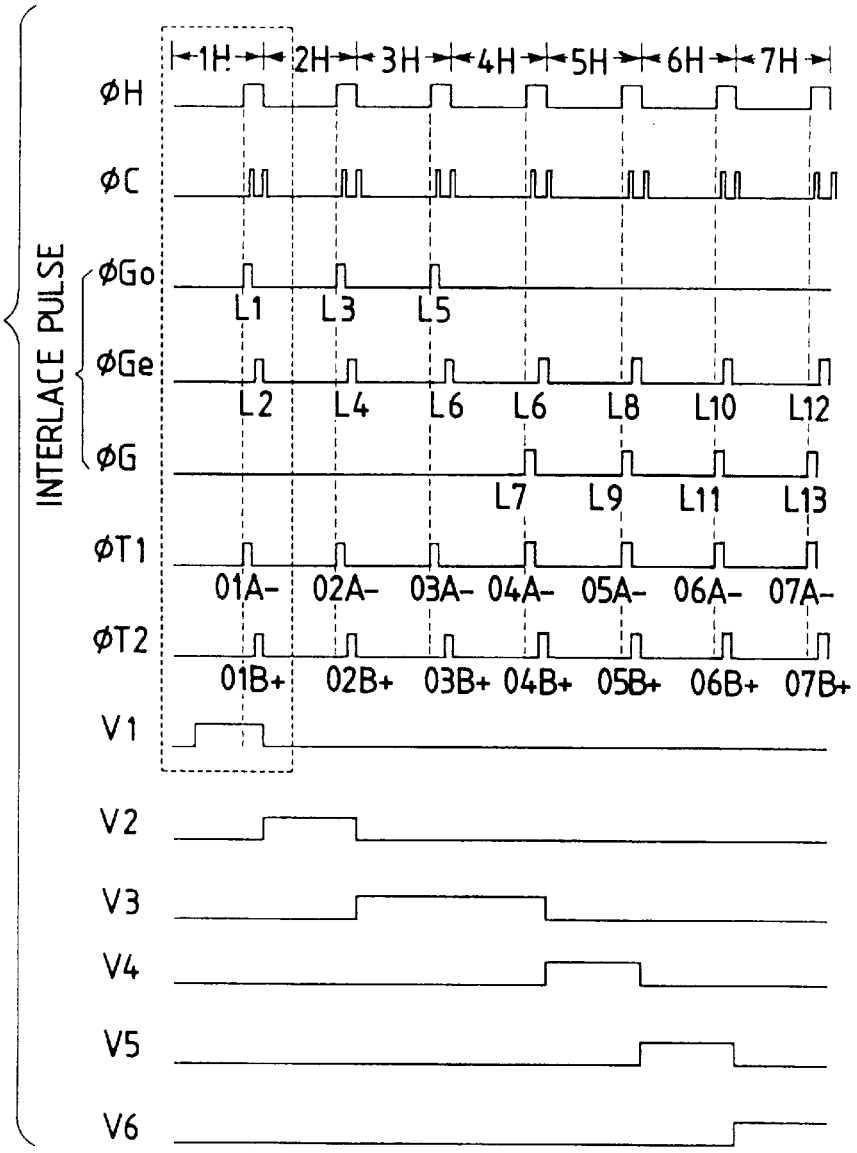
FIGS. 5A and 5B are examples of the timing chart.
Figure 5B:
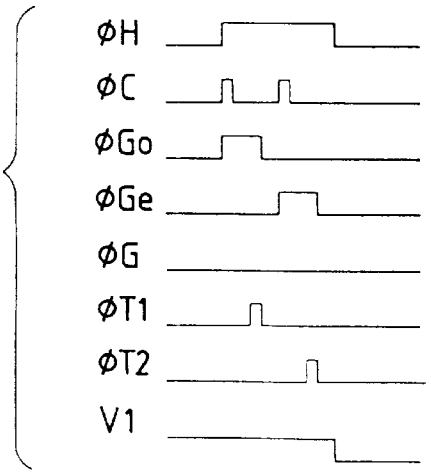

FIGS. 5A and 5B represent the timing charts in this example. FIG. 5B is an enlarged chart of a portion surrounded by the dot line in FIG. 5A. (c) in FIG. 7 represents signal waveform examples of inversion image of a pixel. In the odd field, A phase, negative polarity signal is temporarily stored in the line memory 1, and B phase, positive polarity signal is temporarily stored in the line memory 2, these signals being then transferred to each row. In the figure, ϕH is a horizontal blanking pulse, ϕc is a residual charge reset pulse for selected pixel and vertical signal line, ϕGo, ϕGe, ϕG are interlace pulses, and V1, V2, . . . are vertical scan pulses. The horizontal blanking pulse represents the synchronizing signal for the image signal. ϕT1 is a transfer pulse from the line memory (100-1) to selected row, and ϕT2 is a transfer pulse from the line memory 2 (100-2) to selected row. The interlace pulses V1, V2 represent selected rows at 1H and 2H.

If the vertical pulse V1 gets "H" at 1H, the image signal o1 is sampled in the line memory 1 and the line memory 2 during its effective scan period. The sampling timing id different in sampling phase between odd row and even row of row pixel, as shown (a) in FIG. 7.

If the horizontal blanking period is entered, ϕGo=ϕT1 gets "H", to write a signal o1A− of line memory 1 in the L1 row. Then, the vertical signal line is reset by a ϕc pulse, so that ϕGe=ϕT2 gets "H", to write a signal o1B+ of line memory 2 in the row L2. Thereafter, the vertical signal line is reset to prepare for the signal writing at 2H. Similarly, at 2H, a signal o2A− is written in the row L3, and a signal o2B+ is written in the row L4. And at 3H, a signal o3A− is written in the row L5, but a signal o3B+ is not written in the row L6 because ϕGe remains "L".

Figure 6A:
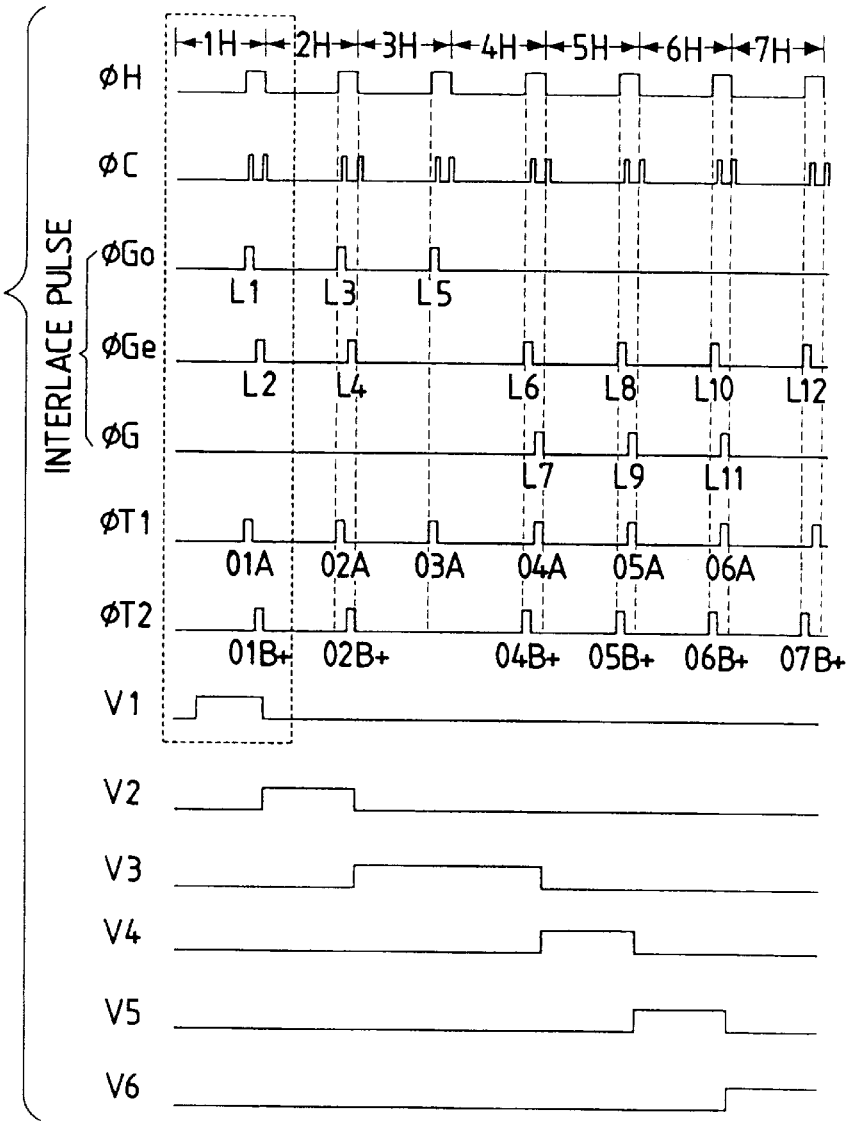
FIGS. 6A and 6B are examples of the timing chart.
Figure 6B:
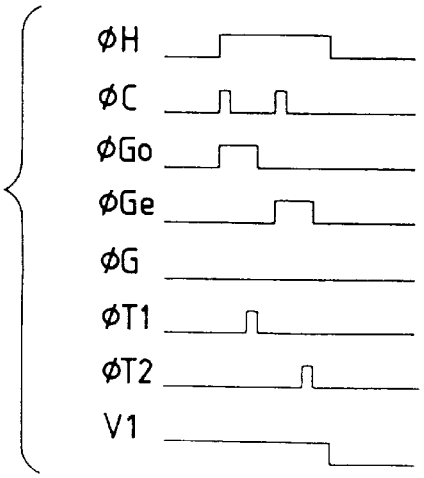

At 4H, an image signal is written from the row L6 into which no signal is written at 3H. Since the selection of row L6 is performed by a ϕGe pulse, the V3 pulse remains "H" at 4H, continuing from 3H. The row L6 is selected by ϕGe pulse, and the row L7 is selected by a ϕG pulse but not by a ϕGo. In this way, for every compression driving of image, the selection of row is switched by a drive pulse of the interlace circuit. Also, by inputting a pulse as shown in FIGS. 6A and 6B, the same display can be effected.

A vertical scan circuit of this example will be detailed below.

Figure 8A:
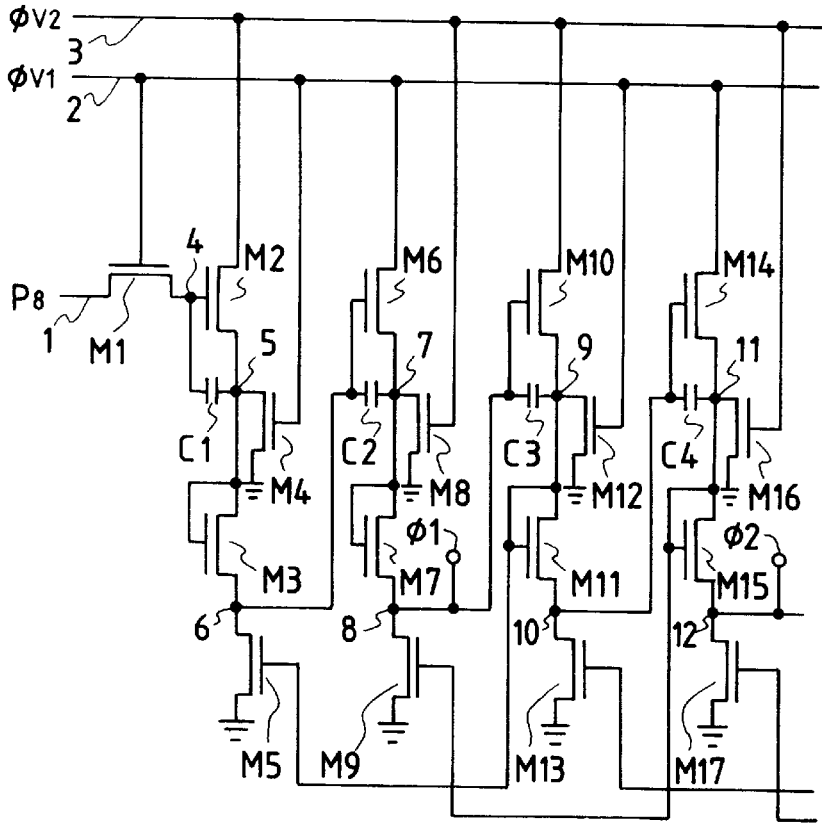
FIGS. 8A and 8B represent circuit diagram and voltage waveform for a bootstrap scan circuit.
Figure 8B:
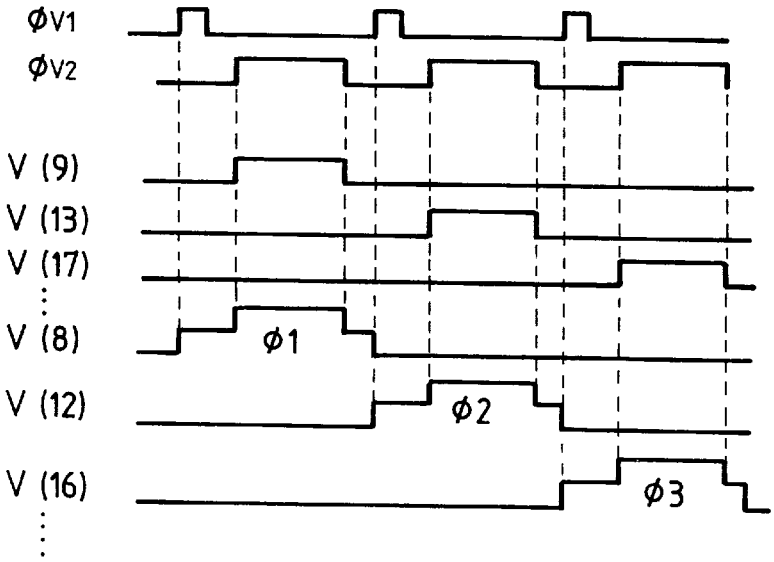

FIG. 8A is a partial circuit diagram of a bootstrap scan circuit in this example, and FIG. 8B is a voltage waveform chart of each portion to present the operation of this example. The vertical scan circuit is of a construction of having n unit circuits connected, in which a scan pulse ϕ1 to ϕn is sequentially output from each unit circuit. Note that the potential of each portion in FIG. 8A is indicated such as V(1) using the number attached to each portion.

In the same figure, if a pulse ϕv1 rises in a state where a pulse Ps is applied in the unit circuit in FIG. 8A, a transistor M1 conducts to cause the potential V(4) to increase. Since the potential V(4) is a gate potential of a transistor M2, the transistor M2 indicates a conductance corresponding to the potential V(4).

Subsequently, if the pulse ϕv1 falls and the pulse ϕv2 rises, the potential V(5) increases through the transistor M2. The increase in the potential V(5) is fed back to the gate of the transistor M2 through a capacitor C1, to cause the potential V(4) to increase due to a bootstrap effect. Since the increase in the potential V(4) acts to increase the conductance of transistor M2, the pulse ϕv2 passes without substantial voltage drop due to transistor M2 to cause the potential V(5) to increase through a transistor M3.

Since the potential V(5) is a gate potential of transistor M5, the conductance of transistor M5 rises correspondingly to the potential V(6).

Subsequently, if the pulse ϕv1 rises, the potential V(7) increases through a transistor M6. Owing to the bootstrap effect as above mentioned, the potential V(6) further increases along with the increase in the potential V(7). Since the increase in the potential V(6) acts to raise the conductance of transistor M5, the pulse ϕv1 causes the potential V(5) to increase through transistors M6 and M7 (see FIG. 8B). Accordingly, a transistor M10 indicates a conductance corresponding to the gate potential V(5).

Subsequently, if the pulse ϕv2 rises, the transistor M5 is turned on, so that the potential V(7) is reset to the ground potential, and the transistor M7 is turned off. Accordingly, the portion at potential V(8) is in floating condition.

At the same time, upon the pulse ϕv2 rising, the potential V(9) increases through the transistor M10. This potential increase causes the potential V(8) to further increase due to the bootstrap effect.

If such change in the potential V(8) is utilized as the scan pulse ϕ1, a high voltage scan pulse can be obtained.

Then, the potential V(8) is reset by the pulse ϕv1, and at the same time the potential V(12) increases, so that the potential further increase by a pulse that follows. This potential V(12) is utilized as the scan pulse ϕ2. Subsequently, likewise, high voltage scan pulses ϕ3 to ϕn are sequentially output in synchronization with the pulse ϕv2.

Note that if the timings for the drive pulses ϕv1 and ϕv2 are appropriately determined in FIG. 2, the waveform for the scan pulses ϕ1 to ϕn can be closer to the rectangle.

Figure 9:
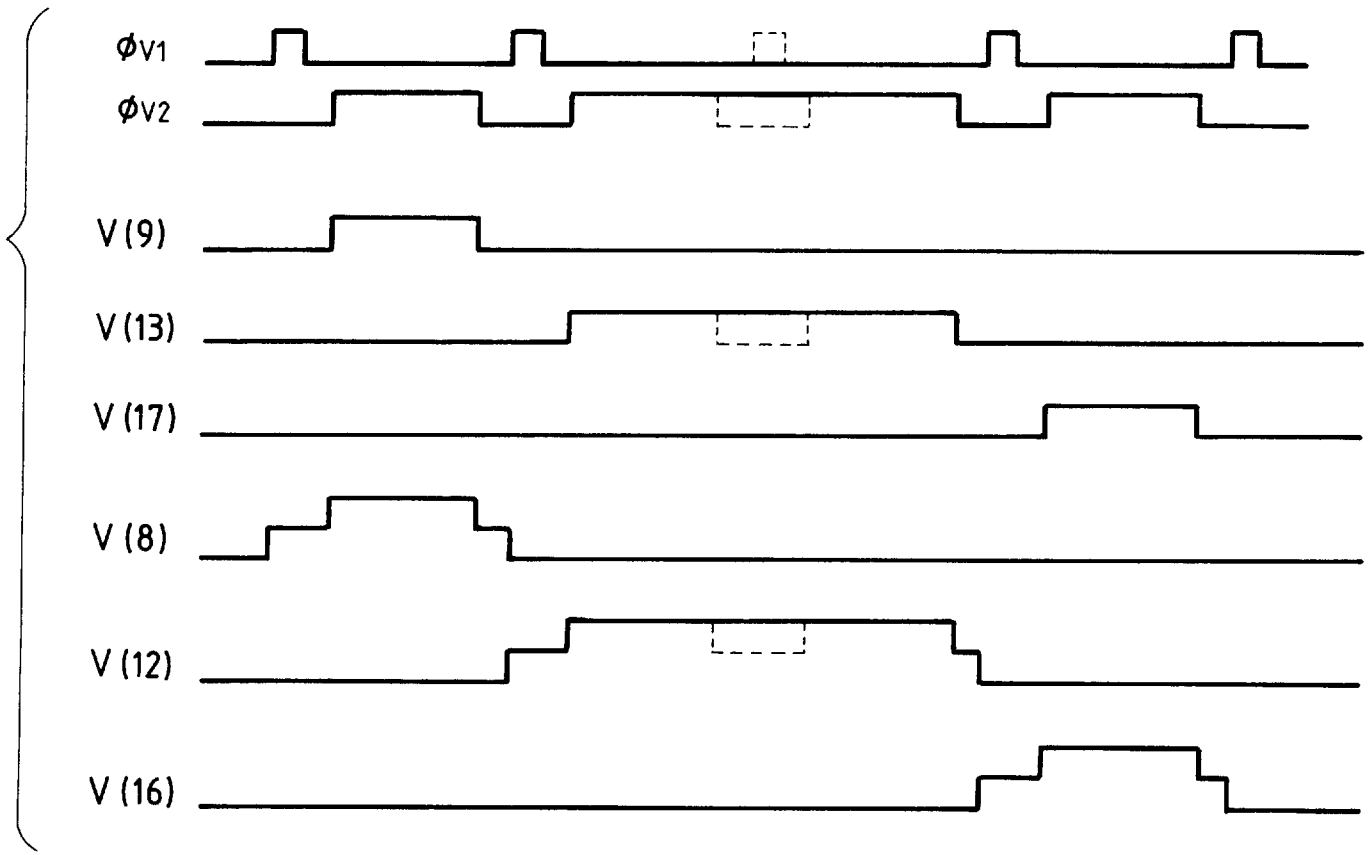
FIG. 9 represents the voltage waveform generating the scan pulse.

In order to cause the vertical scan circuit to output a long pulse, such as V(3) shown in FIGS. 5A and 6B, the pulses such as ϕv1 and ϕv2 of FIG. 9 are input into the vertical scan circuit.

In this example, owing to delta arrangement of pixels, the sampling phase is out of phase by 180° as shown in (a) in FIG. 7, but it will be appreciated that in the aligned arrangement, the image signal is in identical phase for sampling on both rows as shown in (b) in FIG. 7, because two rows are sampled at the same timing. In addition to the bootstrap scan circuit, a logic circuit with CMOS can be available.

EXAMPLE 2

Figure 1:
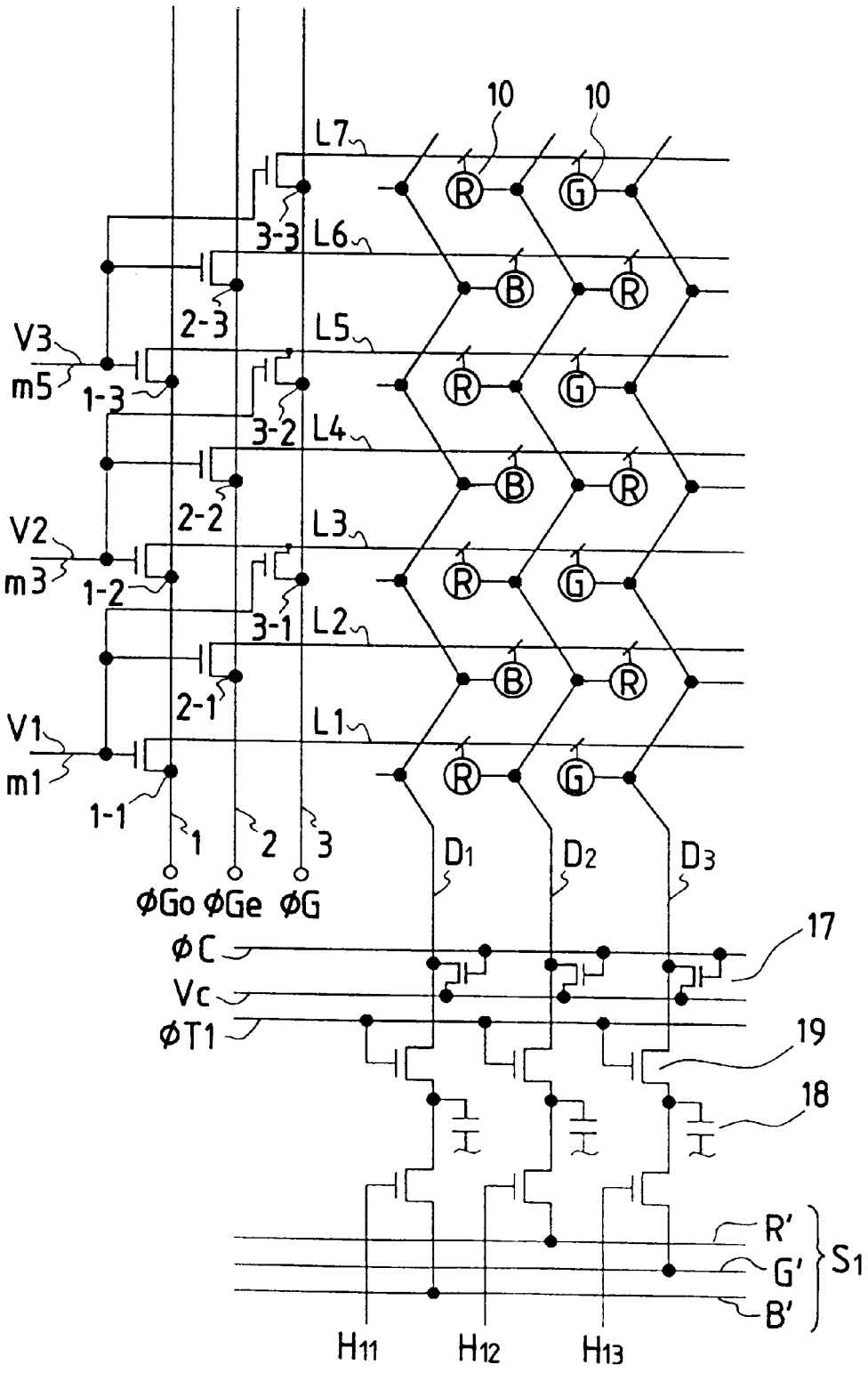
FIG. 1 shows an example of vertical scan altering means of the present invention.

In the example 1, the image signal having different sampling phase and different signal polarity was written in field inversion into each row by two-row interpolation driving. On the other hand, in an example 2, a first image input circuit and a second image input circuit changes the sampling phase of image signal for every 1H. The display is a TFT type liquid crystal display as described in FIG. 1. The signal processing circuits 120-1, 120-2 of FIG. 1 are inverted for every 1H to output signals S1, S2 which are opposite in the signal polarity. FIG. 10 is a chart representing the sampling phase and the signal polarity correspondingly to each row. The meaning "A" and "B" and "+" and "−" is the same as in the example 1. If o1 signal is input in the odd field, A− signal is written in the row L1, and B+ signal is written in the row L2. If o2 signal is input, B+ signal is written in the row L2, and A− signal is written in the row L4. And if o3 signal is written, A− signal is only written in the row L5. The timing chart of this example is omitted, but ϕGo, ϕGe, ϕG, ϕT1, ϕT2, V1, V2, . . . are different from those of the example 1.

In this example, since the inversion operation which the signal processing circuits 120-1, 120-2 perform is to always invert the image signal for every 1H, the direct current potential control feedback time constant is smaller. Hence, the rising at the power on is faster, so that the integrating capacity can be reduced.

EXAMPLE 3

An example 3 is one in which the signal polarity is inverted for every two rows on the display. The display is a TFT type liquid crystal display as in the example 1 and shown in FIG. 1. It is not necessary to change the phase in sampling because of the same sampling phase of input signal into the line memories 1, 2 as in the example 1. FIG. 11 is a chart representing the sampling phase and the signal polarity correspondingly to each row. The meaning "A" and "B" and "+" and "−" are the same as in the example 1. In the example 3, the signal polarity is basically inverted for every 1H, but when the image signal is compressed and written in one row, the inversion operation is temporarily stopped. In the odd field, when signal o3 is only written in the row L5, the inversion of signal o3 to be written from the line memory 2 is temporarily stopped. Also, when signal o7 is only written in the row L12, the inversion of signal o7 to be written from the line memory 1 is temporarily stopped. Thereby, because the positive polarity signal and the negative polarity signal are contained each in two rows, whatever four rows in the panel is noted, the central voltage of inversion signal is not shifted.

EXAMPLE 4

Figure 12:
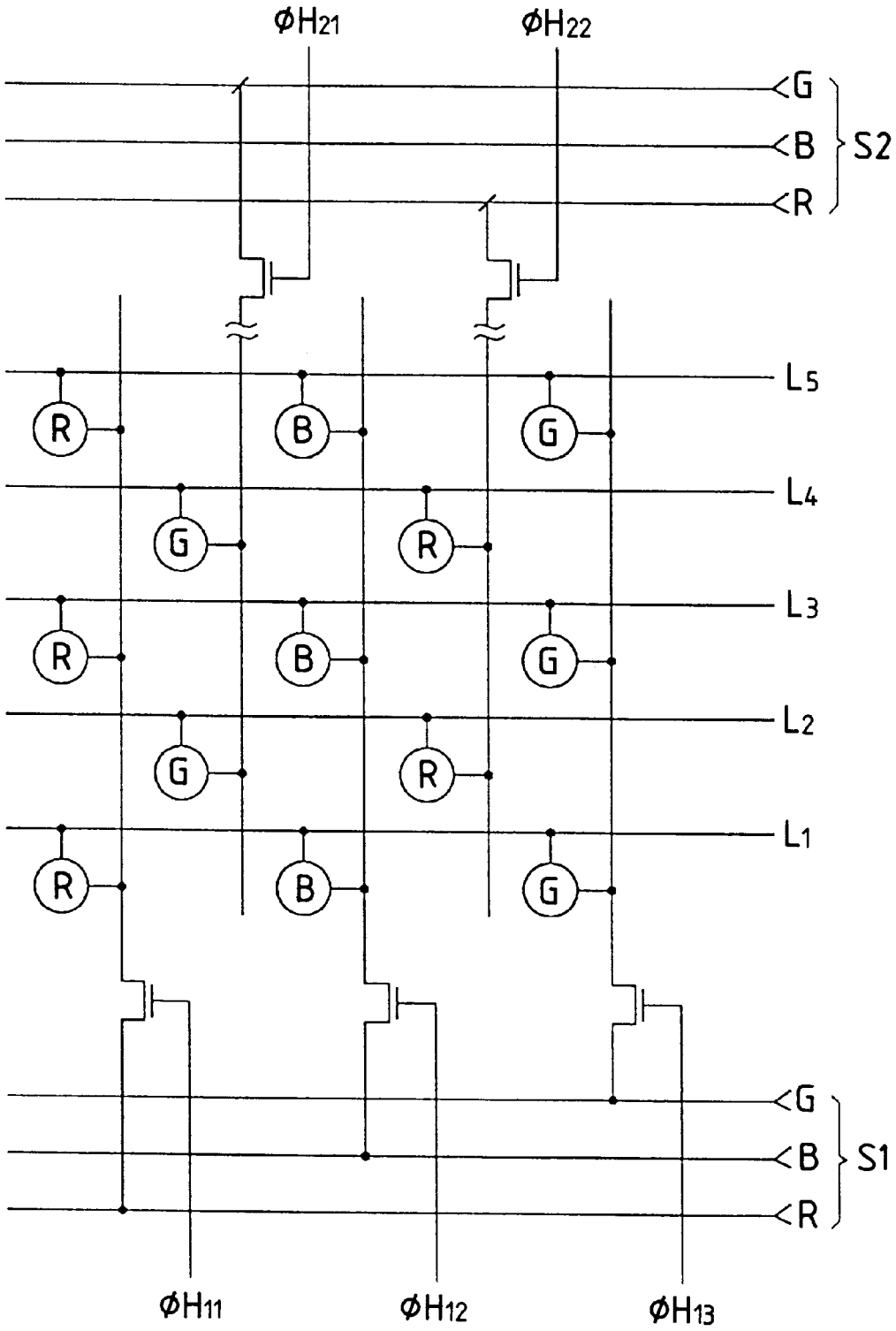
FIG. 12 is a diagram showing a pixel array in an example 4.
Figure 13:
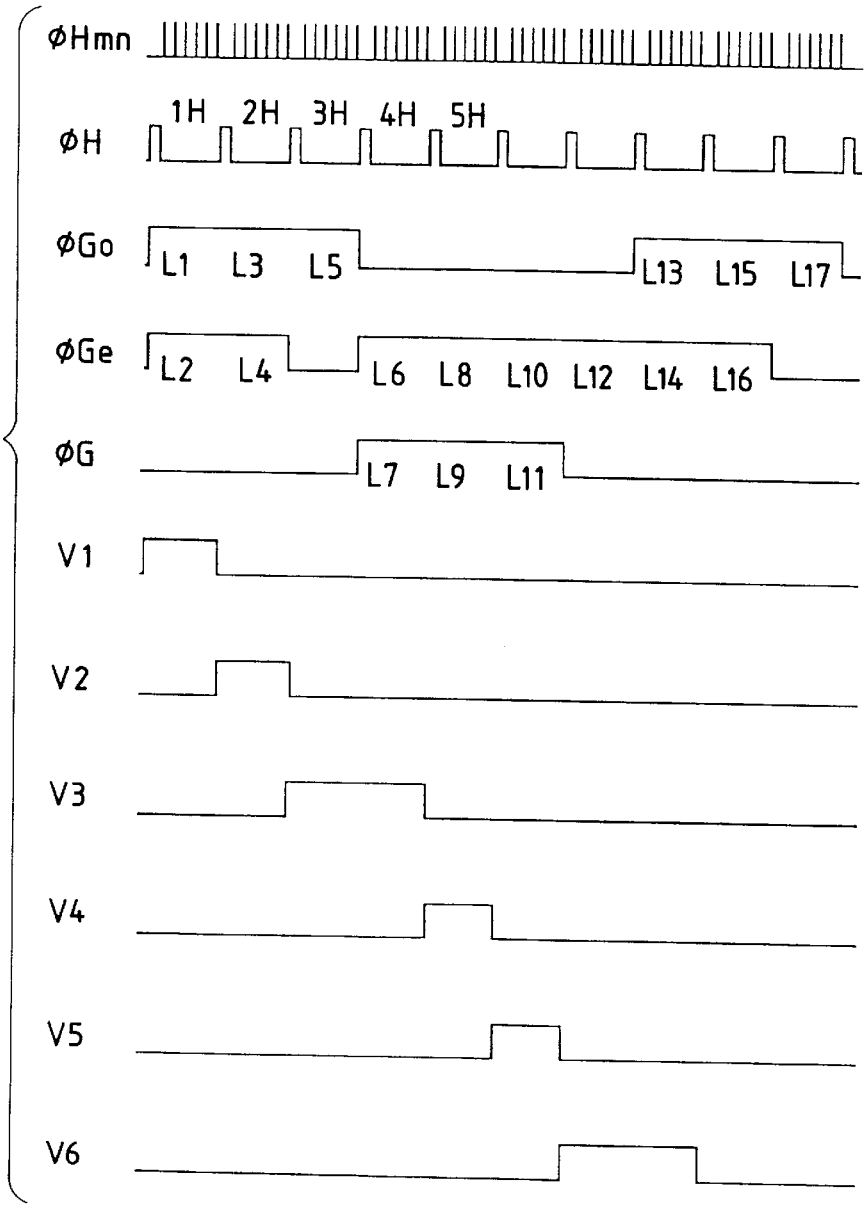
FIG. 13 shows exemplary timing charts.

The number of rows for the display in an example 4 is the same as the number of scan lines for the NTSC signal, wherein the connection to each pixel occurs at every other row. The display is an active matrix type or a simple matrix type liquid crystal display. FIG. 12 represents a liquid crystal display of this example. Since the image signal is directly written in each row during the horizontal effective scan period, no line memory is necessary. Also in this example, there is an interlace circuits for the wirings of rows (L1, L2, . . . ) identical to that of the example 1 as shown in FIG. 2. FIG. 13 is the timing chart of this example.

EXAMPLE 5

The number of rows for the display in an example 5 is the same as the number of scan lines for the NTSC signal, wherein two-row simultaneous driving is made. The display is an active matrix type or a simple matrix type liquid crystal display having the pixels arranged in aligned lattice. The signal to be written in two rows selected simultaneously is sampled at the same timing, as described in (b) in FIG. 7. And because of the use of an interlace circuit as shown in FIG. 1, there is less image distortion with the PAL signal having more scan lines than the NTSC signal. In this example, the level of signal S1 and that of signal S2 are the same. Also, the row shift driving to change the row combination between the odd field and the even field is conducted.

On the other hand, to display image with fidelity from the image signal by two-row simultaneous driving, the signal S1 may be original image signal, and the signal S2 may be the average of original image signal at selected row and image signal at the next row. For example, when the odd1 signal is written in the rows L2 and L3 during 1H period, and original image signal odd1 is written in the row L2, and an average signal ((odd1+odd2)/2) of signal odd2 and signal odd1 during 2H period as prefetched is written in the row L3. Also, the same row combinations may be used for the odd field and the even field.

EXAMPLE 6

In this example, a non-interlace conversion of writing 1H signal in two rows is performed, and data to be written in these two rows is sampled from the image signal individually. Therefore, it is possible to make sampling corresponding to the pixel array of liquid crystal panel. Also, by writing into and reading from the line memory asynchronously, that is, reading image signal data from the line memory while writing it into the same line memory, the line memory can be halved as compared with the synchronization method. It is noted that the vertical resolution can be improved by shifting the row of liquid crystal panel on which the image signal data is written during the same horizontal scan period by one row between the first field and the second field.

Figure 14A:
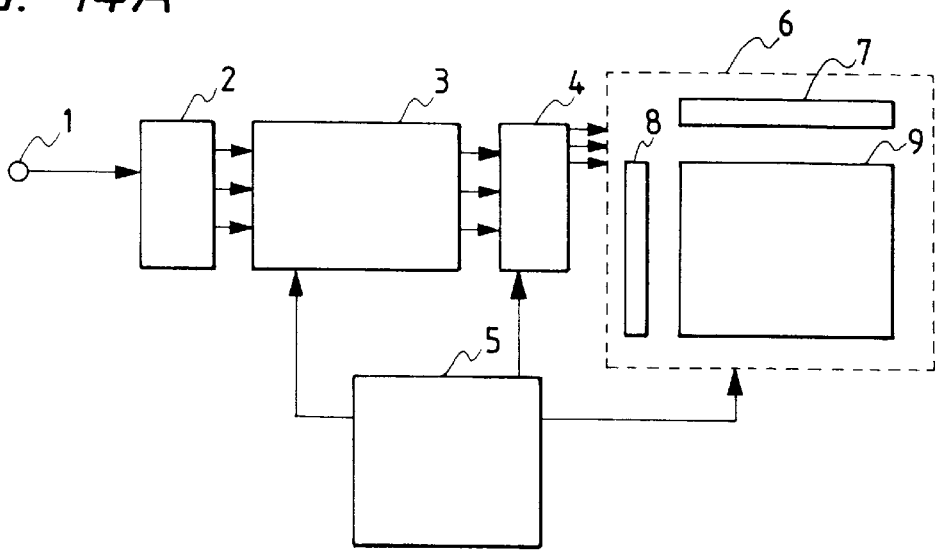
FIGS. 14A and 14B represent a block diagram showing the flow of image signal in examples 6, 7, 8 and a detail diagram of a display unit.

FIG. 14A shows the system configuration of a liquid crystal display unit in the present invention. 1 is an input terminal of image signal such as a television signal, 2 is a decoder for the conversion into RGB color signal, 3 is a line memory, 4 is an inversion control and signal amplification unit for sequentially switching the signal for every predetermined period in forward or reverse direction to provide an alternating current signal for the driving of the liquid crystal, and 5 is a logic unit for forming a pulse for the memory control, the inversion control and the driving of liquid crystal panel. 6 is a liquid crystal panel, of which 7 is a horizontal shift register (HSR) as scanning means in a horizontal direction, 8 is a vertical shift register (VSR) as scanning means in a vertical direction, and 9 is a pixel unit. An interlace signal input into terminal 1 is decoded by the decoder 2, and then converted into a line sequential scan signal in the line memory 3, so that the liquid crystal panel 6 is rewritten over its entire screen at a frequency of 60 Hz (NTSC) or 50 Hz (PAL).

Figure 15:
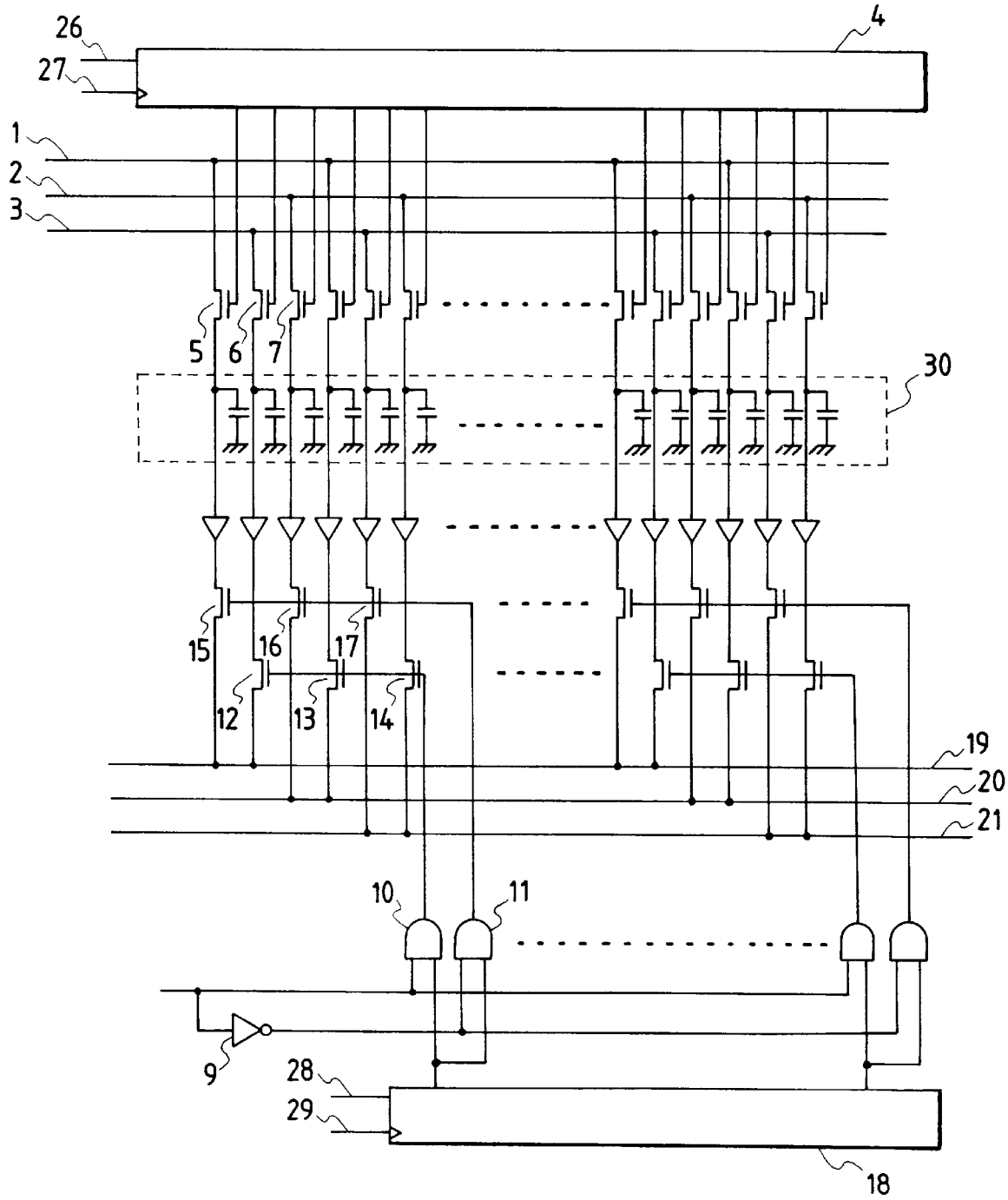
FIG. 15 is a diagram showing the input of image signal.

FIG. 15 shows a block diagram of a line memory unit. 1, 2, 3 are input image signals in the memory unit, 4 is a memory writing shift register (WSR), 26 is a start pulse (WST) for WSR, 27 is a clock pulse for WSR, 18 is a memory reading shift register (RSR), 28 is a start pulse (RST) for RSR, and 29 is a clock pulse for RSR. 19, 20, 21 are output lines for image signal data.

Figures 16, 18:
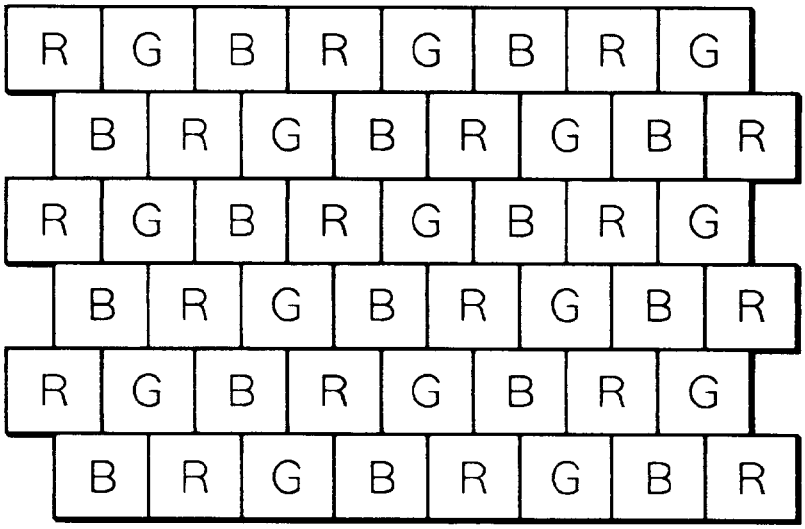
FIG. 16 is a view showing the color array of pixel.
FIG. 18 is a chart showing the image signal for each row on a panel in an example 6.

FIG. 16 shows a color array of pixel. The pixel arrangement is in a mosaic type delta array. Therefore, different color pixels are connected to the vertical signal line (15 in FIG. 14B). Also, the pixel position in the horizontal direction is shifted by 0.5 pixel, or 1.5 pixels for the same color pixel, between the even row and the odd row.

Figure 14B:
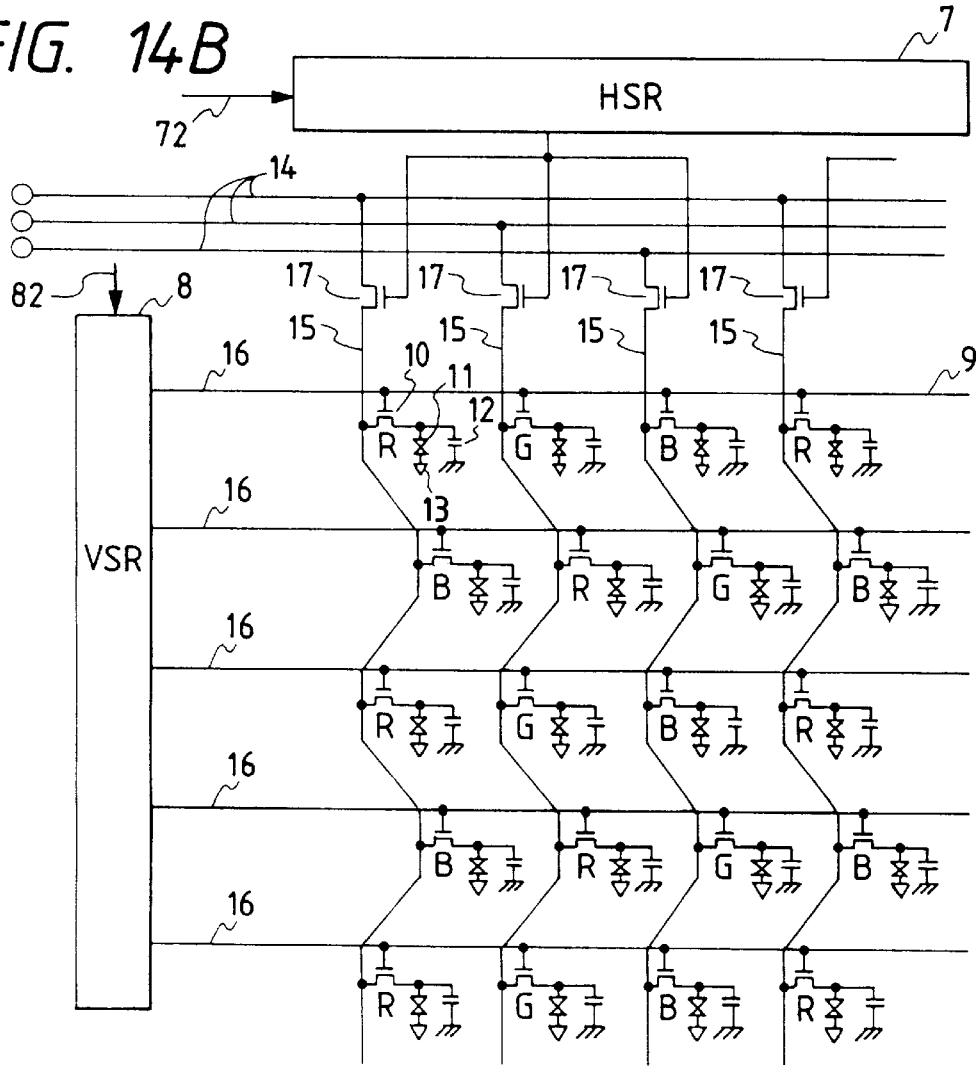

FIG. 14B shows the circuit configuration of a display unit in the liquid crystal panel. 7 is a horizontal shift register (HSR), 8 is a vertical shift register (VSR), and 9 is a pixel unit. 10 is a thin film transistor, 11 is a liquid crystal, 12 is a holding capacitor, 13 is an opposed electrode, 14 is an image signal input line, 15 is a vertical signal line, 16 is a gate line, and 17 is a signal line select switch. 71 is a start pulse (HST) for HSR, 72 is a clock pulse for HSR, 81 is a start pulse (VSR) for VSR, and 82 is a clock pulse for VSR.

Figure 17:
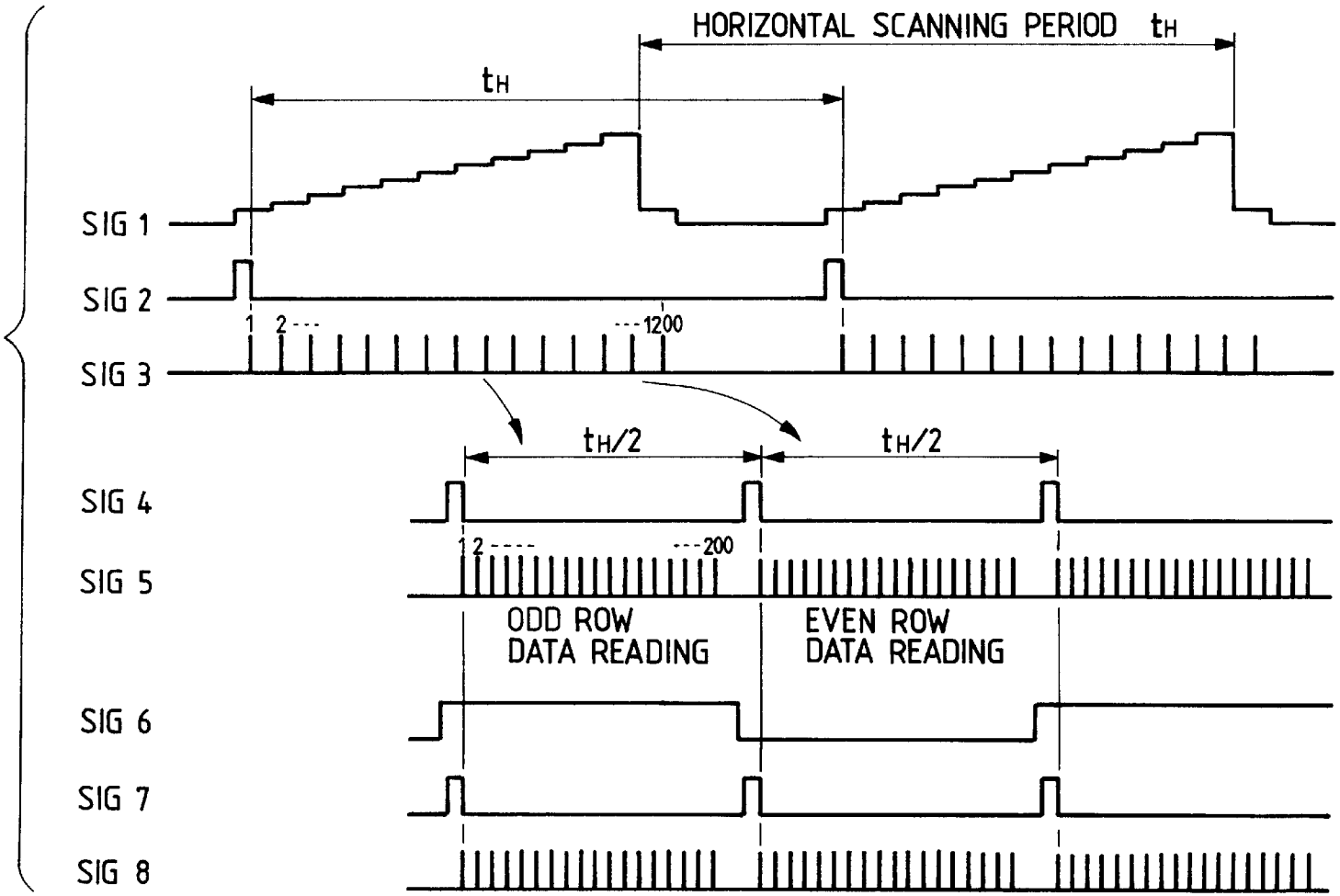
FIG. 17 shows exemplary timing charts.

FIG. 17 is a chart showing the operation timing for the line memory unit and the liquid crystal panel unit, wherein SIG1 is an input image signal (R, G, B) for the memory unit, SIG2 is a start pulse of the memory writing shift register (WSR), SIG3 is a WSR clock pulse, SIG4 is a start pulse of the memory reading shift register (RSR), and SIG5 is a clock pulse for RSR. SIG6 is a signal (ODD) indicating whether the row number is odd or even, SIG7 is a start pulse of the horizontal shift register (HSR) for the liquid crystal panel, and SIG8 is a clock pulse for HSR.

Referring to FIG. 15, there is described in this example an instance of displaying on the liquid crystal having a horizontal pixel number of 600, a vertical pixel number of 480. The image signals of this example is sampled from right to left. The image signals 1, 2, 3 which have been subjected to gamma correction suitable for the liquid crystal display in the decoder unit at the former stage and intermediate amplification in accordance with the dynamic range of line memory are sampled by the shift register 4 having 2×600 stages, and written into the line memory 8 through the transistors 5, 6, 7, . . . The sampling is performed 1200 times which is twice a horizontal pixel number of the liquid crystal panel during one horizontal period. The sampling is performed in the order of R, G, B in accordance with the liquid crystal panel, and the signal is written into the line memory in the order of Ro1, Ge1, Bo1, Re1, Go1, Be1, . . . (Roi, Goi, Boi represent data corresponding to the even row of liquid crystal panel, Rei, Gei, Bei represent data corresponding to the odd row of liquid crystal panel).

On the other hand, the reading of data from the line memory is performed separately for the even row data of liquid crystal panel Ro1, Go1, Bo1, Ro2, Go2, . . . Ro200, Go200, Bo200, and the odd row data Re1, Ge1, Be1, Re2, Ge2, . . . Re200, Ge200, Be200, both being transferred to the liquid crystal panel during one horizontal scan period. Since at the time of sampling, the phase is shifted by the amount corresponding to one pixel of liquid crystal panel between Roi, Goi and Boi, and between Rei, Gei and Bei, the reading from the line memory and the writing into the liquid crystal panel are performed at the same time for the above three pixels. That is, when data at the first row is transferred to the liquid crystal panel, the transistors 12, 13, 14 conduct, because an AND gate 10 gets "H" if an ODD signal 8 gets "H", the output at the first stage of the shift register 18 gets "H", so that data Ro1, Go1, Bo1 are output to the output signal lines 19, 20, 21 at the same time. Similarly, when data at the second row is transferred to the liquid crystal panel, the transistors 15, 16, 17 conduct, because an AND gate 11 gets "H" if ODD signal 9 gets "H" and the output at the first stage of the shift register 18 gets "H", so that data Re1, Ge1, Be1 are output to the output signal lines 19, 20, 21 at the same time.

The writing into and the reading from the line memory are performed in the following order. First, upon a start signal 26 of the shift register 4 at the writing side, the shift register 4 starts the operation, making sampling 1200 times during one horizontal scan period, and sequentially writing into the line memory. At the time when the sampling (600+6) times or more is ended, upon a start signal 28 of the shift register 18 at the reading side, the operation of the shift register 18 if started, so that data at the odd address is read in the order of 1, 3, 5 addresses (Ro1, Go1, Bo1), and 7, 9, 11 addresses (Ro2, Go2, Bo2) of the line memory, three data at the same time. If the frequency of read clock at this time is three times that of the write clock, the reading up to the (1200−6)-th address has been performed at the time when the writing into the line memory is ended, whereby the reading is not performed before the writing into the line memory. Also, the reading is performed within $t_H/2$ which is half one horizontal scan period $t_H$, while the writing into the first row of the liquid crystal panel is ended. During the next $t_H/2$ period, data at the even address is read, three data at the same time, in the order of 2, 4, 6 addresses (Be1, Re1, Ge1), 8, 10, 12 addresses (Be2, Re2, Ge2), . . . in the same manner as above described. Then, the sampling of image signal for the next horizontal scan period is performed, and data is written into the line memory, but the order of the writing and reading is not reversed if the reading precedes the writing.

Where the reading of data is performed after the end of the writing into the line memory, a line memory for the image signal during two horizontal scan periods is required, but by reading the image signal data from the line memory while writing into the same line memory, as in this example, the line memory can be halved.

The above timing is shown in FIG. 17. The read data is converted into an alternating signal by an inversion amplifier 4 of FIG. 14A, and input into the liquid crystal panel 6. The horizontal shift register 7 of this liquid crystal panel has the same stage number as the shift register (18 in FIG. 15) in the line memory unit, and is driven at the same timing. Also, the vertical shift register 9 of 480 stages performs the shift operation prior to a reading start signal in the line memory unit.

By repeating the above operation during 240 horizontal scan periods, the image signal data can be written into the 480 rows in the liquid crystal panel for one field. Note that the row of the liquid crystal panel on which the image signal data is written during the same horizontal scan period may be the same or shifted by one row as shown in FIG. 18, between the first field and the second field, but when shifted by one row, the vertical resolution can be improved. FIG. 18 shows the signal to be written onto each row from 2k to 2(k+1) for every field.

Herein, Ok and O'k are data in the first field (odd field), and Ek and E'k data in the second field (even field), which is obtained by sampling the image signal during the k-th horizontal scan period for the interlace signal, in accordance with the pixel array in the odd row and the even row of the liquid crystal panel and at different timings. In this case, the start timing of the vertical shift register in the second field occurs $t_H/2$ ahead of the first field, and the reading order of the line memory occurs from the odd row data (Be1, Re1, Ge1, . . . ).

Figure 19:
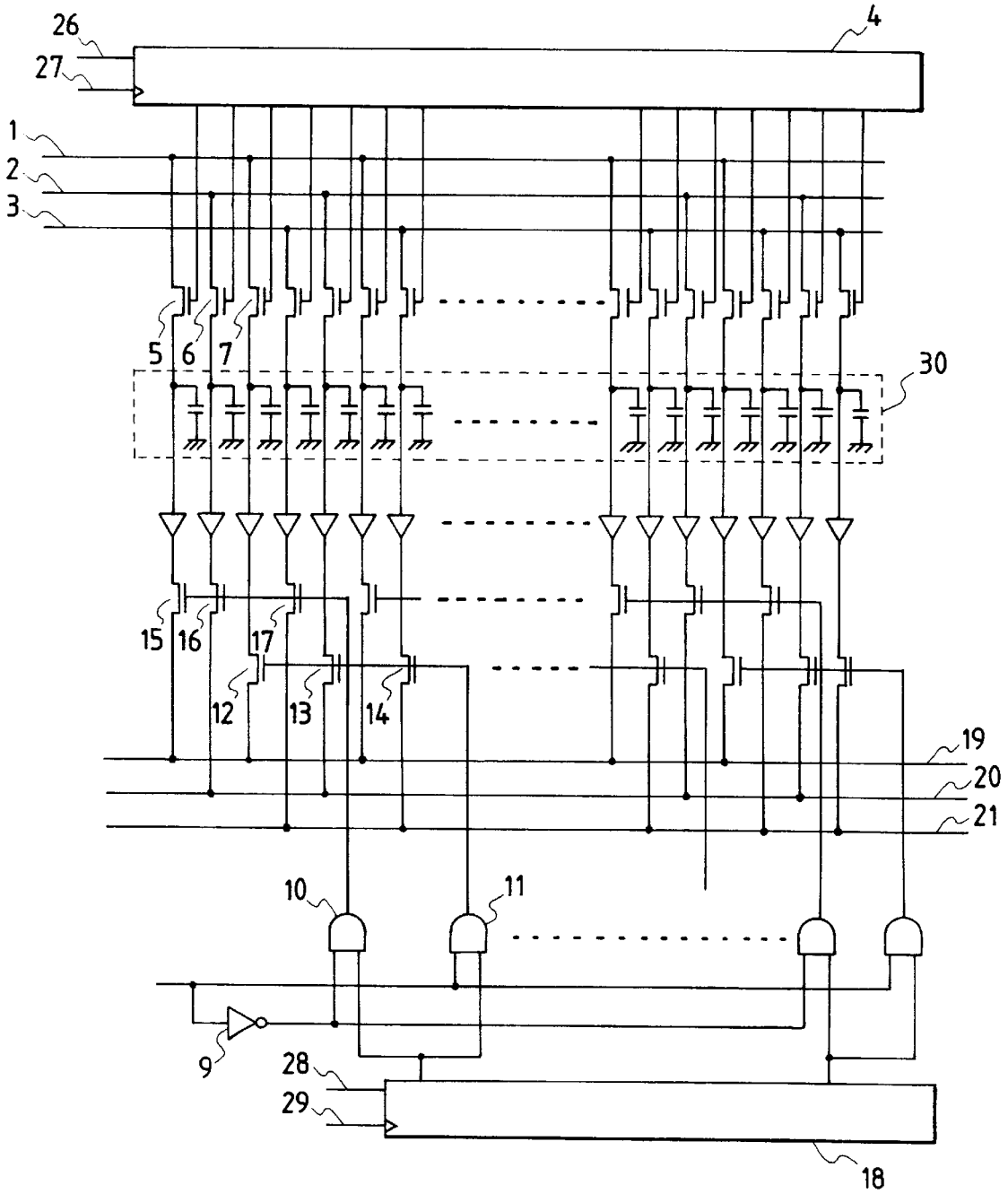
FIG. 19 is a diagram showing the input of image signal.
Figure 20:
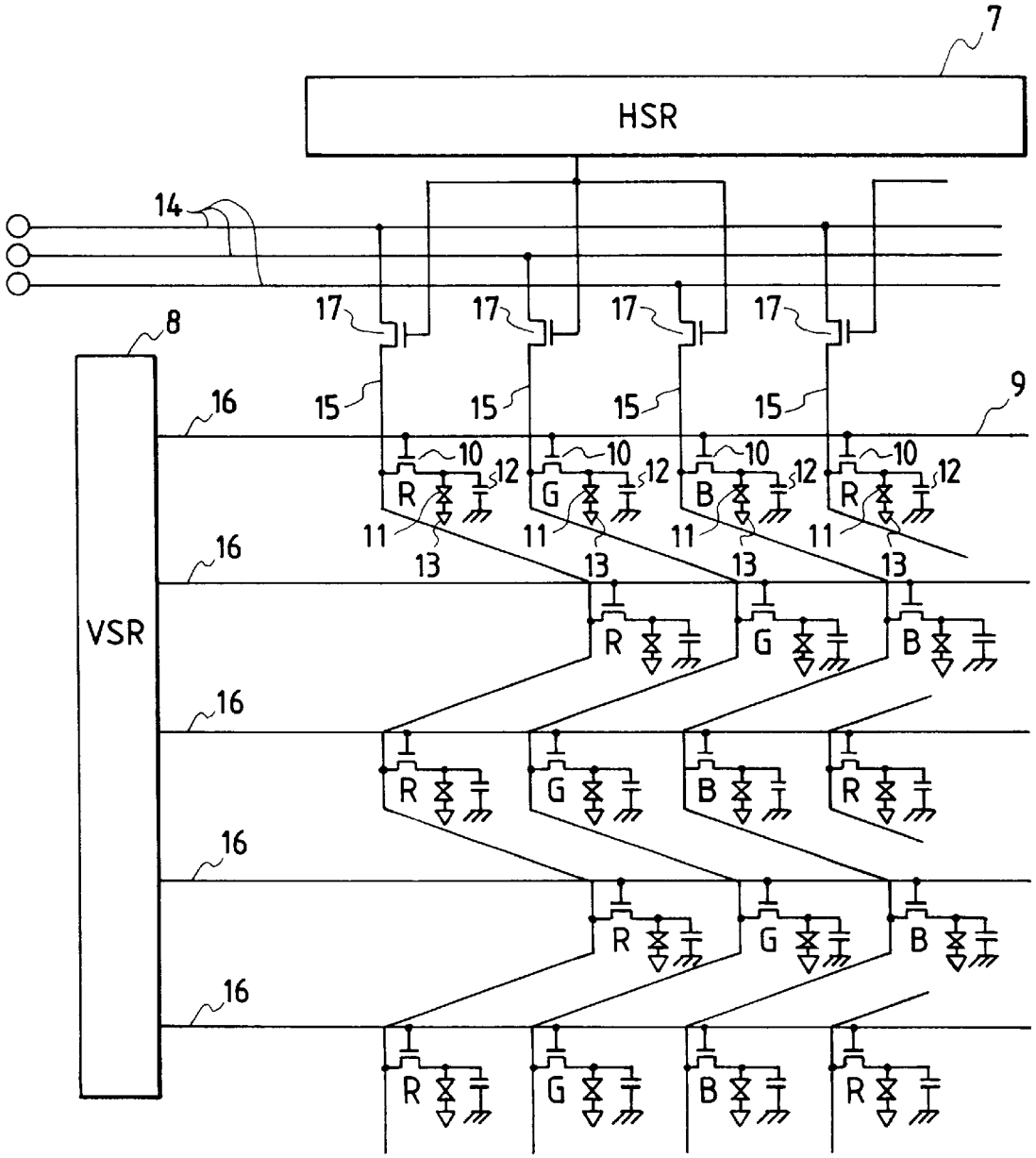
FIG. 20 is a view showing the color array of pixel.

The liquid crystal panel has different color pixels connected to the vertical signal line, but another example is a liquid crystal panel in which the same color pixels are connected to the vertical signal line as shown in FIG. 20, in which case the wiring on the reading side of the line memory should be made as shown in FIG. 19.

While in this example, a capacitor is used as holding means of image signal which is held in the state of analog signal (memory unit 3 in FIG. 14A), this portion may be constituted of an A/D converter, a digital line memory, and a D/A converter.

And by providing vertical scan altering means as previously described, the image signal of various standards can be displayed.

The horizontal pixel array of adjacent two lines can be shifted by 0.5 pixel, and the color pixel of R, G, and B can be arranged in delta configuration, whereby a smooth display with high horizontal resolution can be effected.

Also, by reading the image signal data from the line memory while writing into the same line memory, the line memory can be halved as compared with when the data is read after the end of writing into the line memory.

Further, by shifting the row of liquid crystal panel on which the image signal data is written during the same horizontal scan period between the first field and the second field, by one row, the vertical resolution can be improved.

EXAMPLE 7

This example is configured to rewrite the entire screen at every 60 Hz, by serially inputting the signal, forming two kinds of signals sampled at different timings from the same horizontal scan signal, using an analog line memory capable of serially outputting data in different order and at different frequency when reading than when inputting, and writing them into two pixel rows during one horizontal scan period, while shifting one row the combination of two rows to scan in the even field and the odd field. Thereby, in the low cost, smaller systems, it is possible to realize the good image quality with high resolution and high gradation, and without flicker, and readily form special reproduction image such as enlargement and reduction of screen in the horizontal direction, or left and right inversion of screen, with less wirings.

FIG. 16 shows a color array of pixels in the liquid crystal panel for use in this example. Herein, the circuit configuration of a display unit for the liquid crystal panel is as shown in FIG. 14B, and the pixel arrangement is in a mosaic type delta array. Therefore, different color pixels are connected to 15 vertical signal lines of FIG. 14B. Also, the position of the same color pixel in the horizontal direction is shifted by one half period (1.5 pixels) between the even row and the odd row, the timing for each color signal is changed for the sampling between the even row and the odd row.

In FIG. 14A, the system configuration for a liquid crystal display using a line memory which implements the serial IN–serial OUT employing row types of shift registers for reading and writing is shown. 1 is an output terminal for TV signal, 2 is a decoder unit for converting composite TV signal into RGB color signal, 3 is an analog line memory unit, 4 is an inversion control and signal amplification unit for sequentially switching the signal for every predetermined period in forward and reverse direction to provide a signal for the driving of liquid crystal, and 5 is a logic unit for forming a pulse for the memory control, the inversion control and the driving of liquid crystal panel. 6 is a liquid crystal panel, of which 7 is a horizontal shift register (HSR) as scanning means in the horizontal direction, 8 is a vertical shift register (VSR) as scanning means in the vertical direction, and 9 is a pixel unit. An interlace signal input at 1 is color decoded at 2, and then converted into line sequential scan signal by the line memory at 3, so that the liquid crystal panel at 6 is rewritten on its entire screen at 60 Hz period. Herein, the signal information is sampled according to a spatial arrangement of R, G and B pixels and is written into the memory 3. Besides it is possible that the RGB signal is subjected to a different amount of delay in accordance with the order of pixel array for RGB in the decoder unit 2. In this case, the signal information can be obtained in accordance with the spatial arrangement of pixels on the liquid crystal at the same sampling pulse, whereby the frequency of sampling clock for the memory unit and the liquid crystal panel is made one-third.

Figure 21:
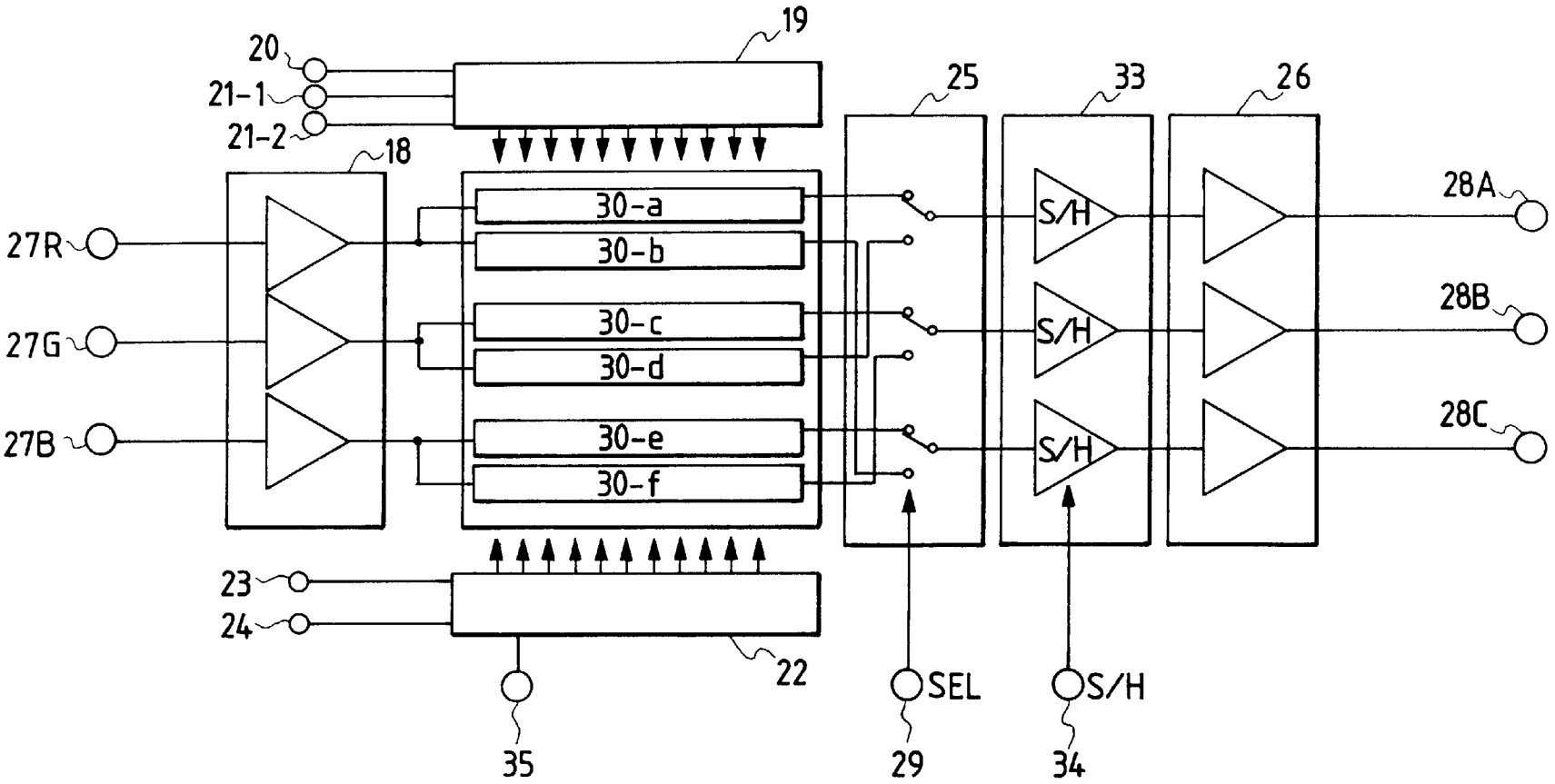
FIG. 21 is a block diagram of an analog line memory.
Figure 28:
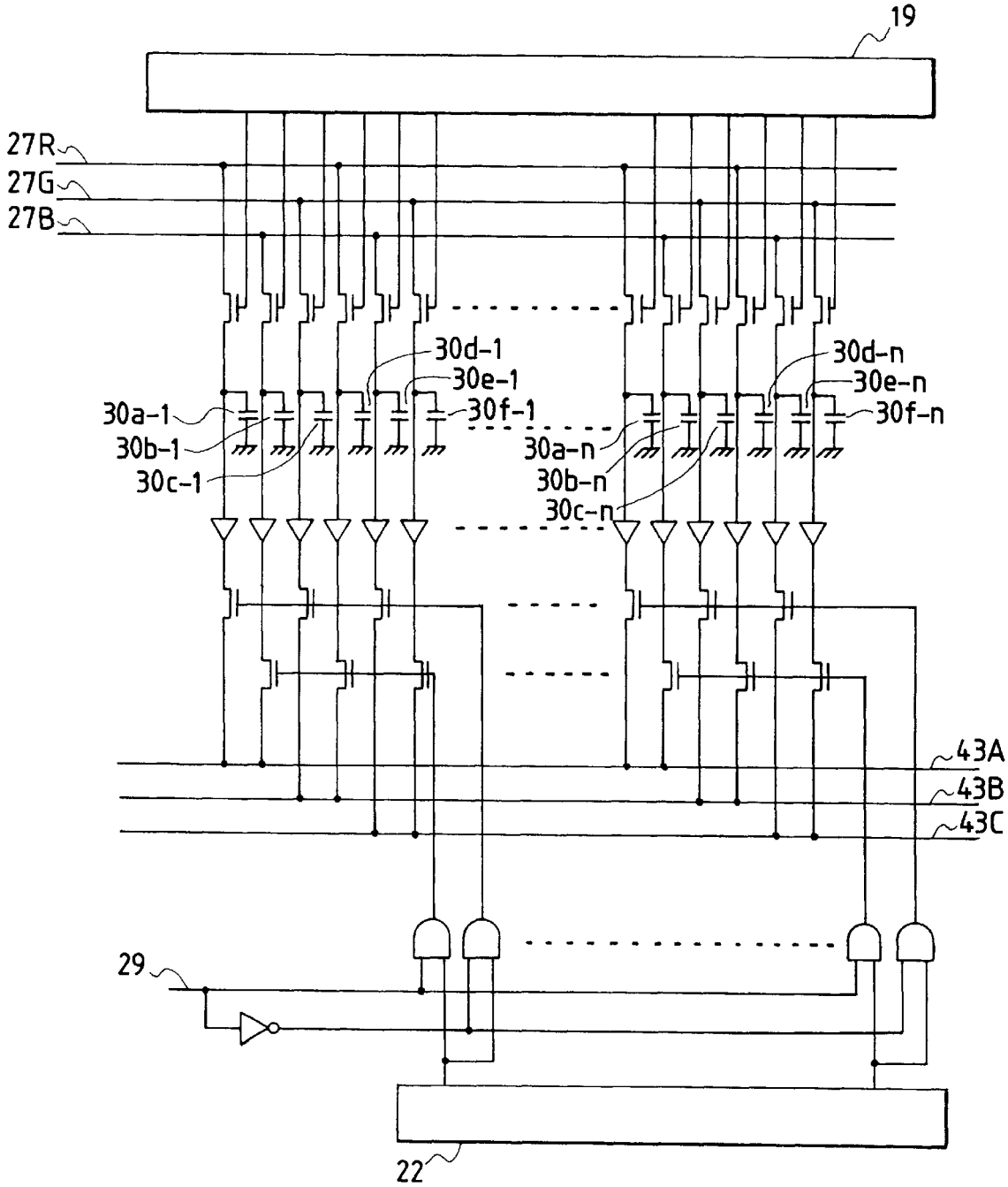
FIG. 28 is a chart showing the input of image signal.

FIG. 21 shows a block diagram of the analog line memory unit in this example. 18 is an input stage of the memory unit, 19 is a memory writing shift register (WSR), 20 is a WSR start pulse (WST), 21-1, 21-2 are WSR two-phase clock pulses (WCLK1, WCLK2), 22 is a memory reading shift register (RSR), 23 is an RSR start pulse (RST), and 24 is an RSR clock pulse (RCLK). 25 is switching control unit for switching the signal to be sent to the video line in accordance with the color array for the liquid crystal panel. 33 is a sample and hold circuit, and 34 is an input terminal of sample and hold pulse. 26 is an output stage of the memory unit. 27R, 27G, 27B are input terminals for RGB signals, 28A, 28B, 28C are output terminals for outputting data through the switching by switches at 25 between the even row and the odd row of the liquid crystal screen for writing R and G, G and B, B and R, in which 29 is an input terminal of the switching control signal. 35 is a control terminal of the switching control signal. 35 is a control terminal for fine regulating the reading timing from the memory, its role being described later. 30*a* to 30*f* are memory arrays for the even row and the odd row of the liquid crystal screen of each color of RGB, which are allocated from the same horizontal signal alternately at every other clock for the shift register for writing. A specific constitutional example of this portion is shown in FIG. 28. Herein, 43A, 43B, 43C indicates the output line of memory between 25 and 33 in FIG. 21. Also, 1 to n of 30*a* to 30*f* represents 1 bit to n bit of the memory array, respectively. When the signal is read, 30*a*, 30*c*, 30*e* or 30*b*, 30*d*, 30*f* is selected by a switching control signal at 29.

Figure 22:
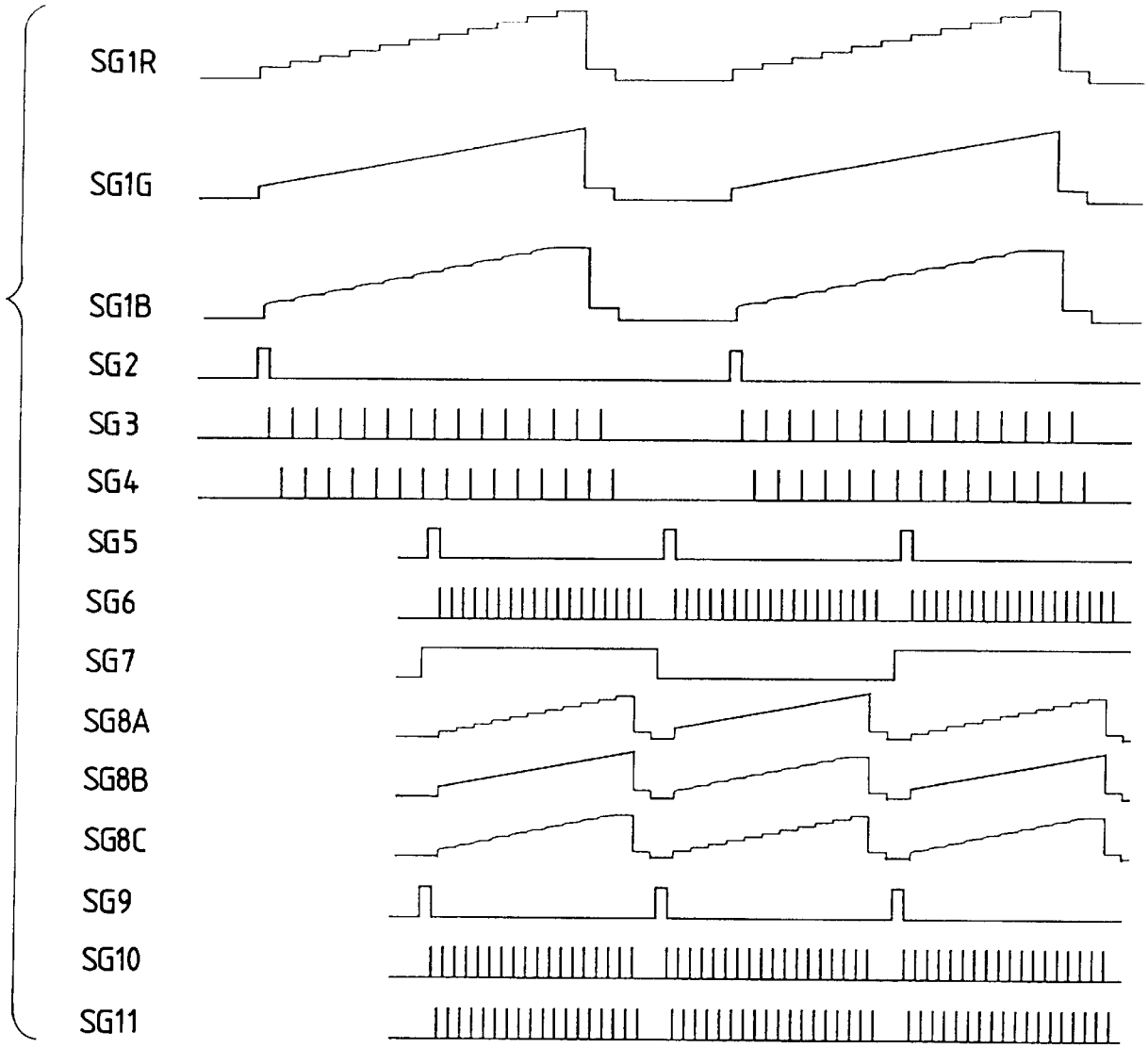
FIG. 22 shows exemplary timing charts.

FIG. 22 shows the liquid crystal and memory driving timing in the horizontal scan period. SG1R is a red image signal, SG1G is a green image signal, SG1B is a blue image signal, SG2 is WST, SG3 is WCLK1, SG4 is WCLK2, SG5 is RST, SG6 is RCLK, SG7 is a color select switching signal, SG8A to C are signals converted into the line sequential scan signal which is output from the memory unit, SG9 is HST, SG10 is H1, and SG11 is H2.

By taking such configuration, the serial signal sampled at double density is taken out at every other time, then modified to two serial signals of which the order is changed to conform to the pixel arrangement of the liquid crystal screen, and scanned continuously during one horizontal scan period by the reading shift register operating at another clock, while being switched to each output terminal.

Figure 31A:
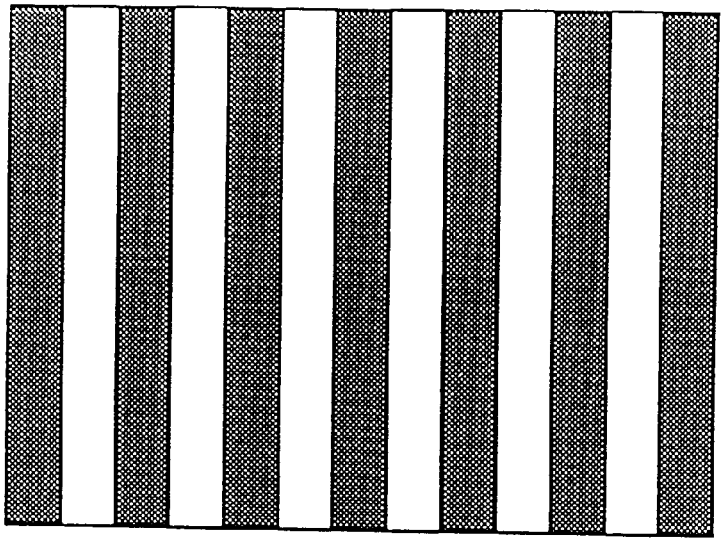
FIGS. 31A and 31B are typical views of an original signal image and an image in an example 8.
Figure 31B:
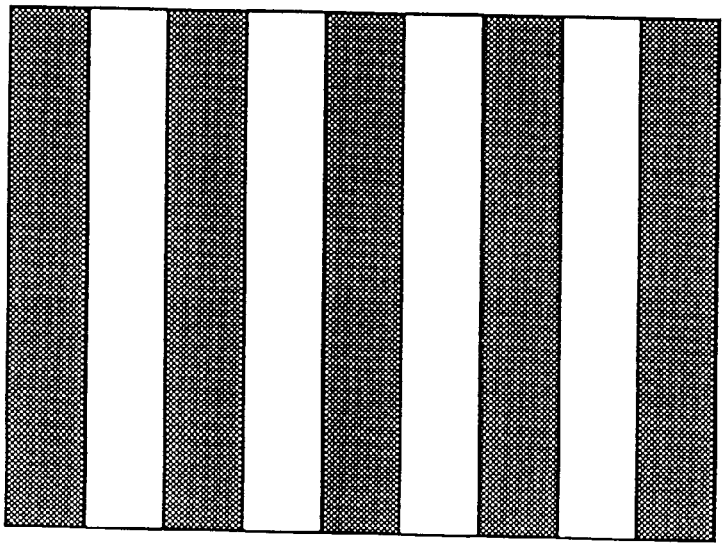
Figure 32:
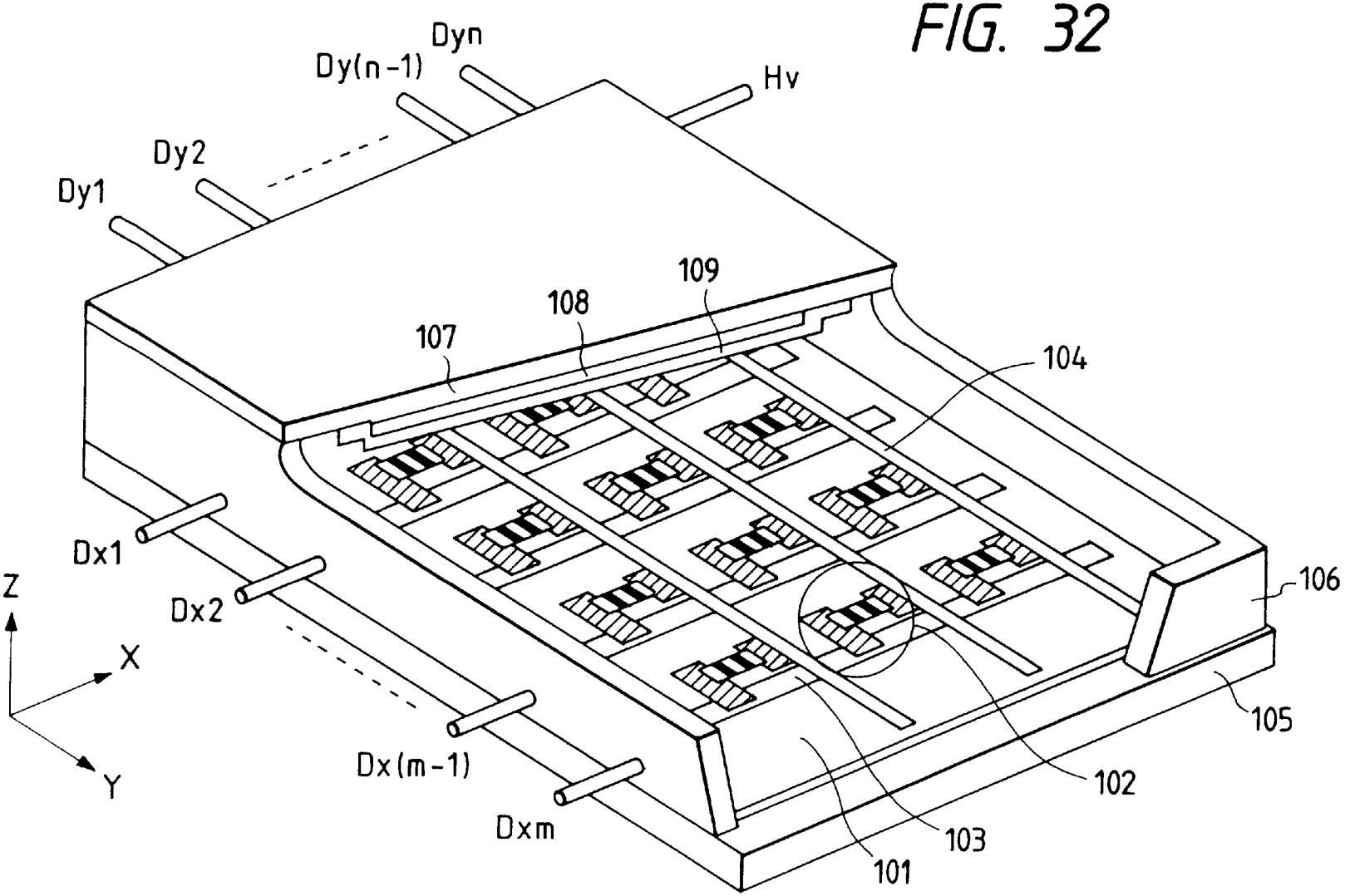
FIG. 32 is a view showing an electron beam flat display.
Figure 33A:
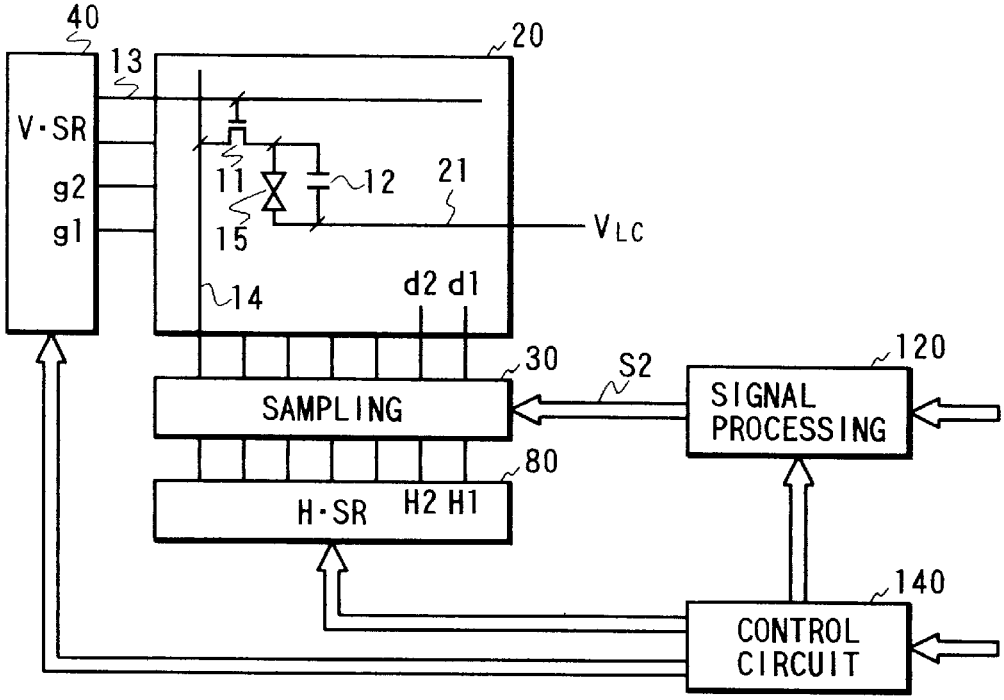
FIGS. 33A and 33B are block diagrams of the conventional flow of image signal and a detail diagram of pixel.
Figure 33B:
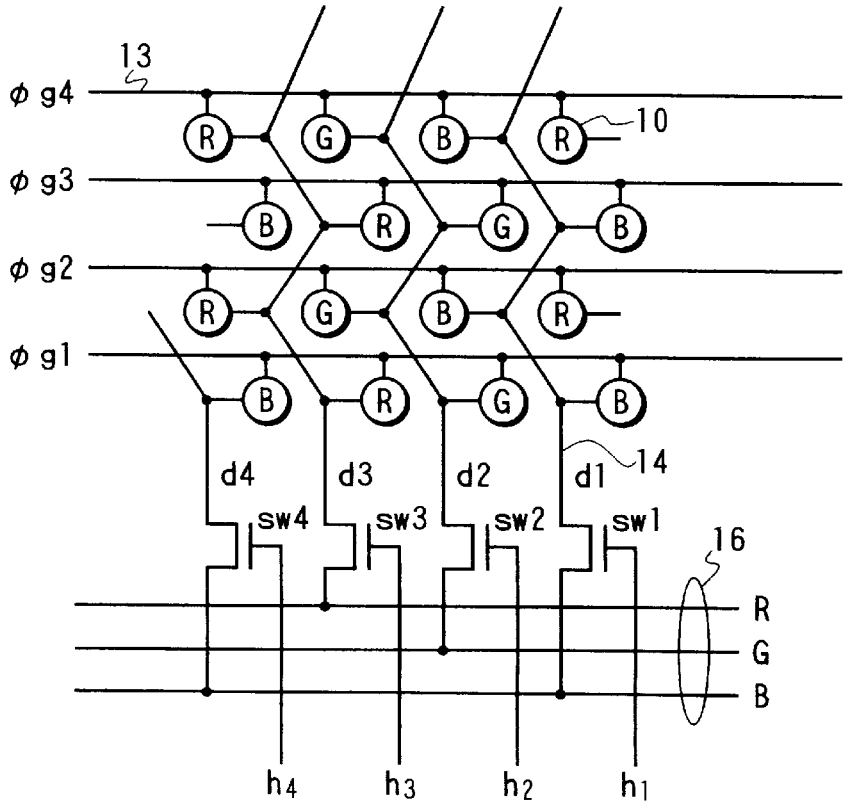

FIGS. 31A and 31B show the signals to be written into each row (2n to 2(n+2)) for every field on the liquid crystal panel in this example. Herein, $O_n(m)$ and $O_n(m)$ are data which is obtained by sampling the n-th signal in the odd row for the interlace signal in the m-th frame at different timings in accordance with the pixel array of the even row and the odd row for the panel.

Since both the even row and the odd row on the screen is rewritten at every one field (60 Hz), the problem with the varying resolution and flicker can be resolved. Also, observing one field, the resolution in the vertical direction is halved from that of the original signal, but by shifting one row in the next field for the display, the vertical resolution is raised artificially.

In this way, in a low-cost line memory, the interlace signal is converted into the line sequential scan signal to realize the excellent image quality.

The serial signal sampled at double density herein is modified to two serial signals of which the order is changed to conform to the pixel arrangement of the liquid crystal screen, but when the color array order for the even row and the odd row is the same such as an inline-type pixel array, the interlace signal is converted into the line sequential scan signal to have effect of realizing the excellent image quality, in the line memory with low cost, without changing the order of sampled signals, depending on the relation between pixel array and memory array.

Figures 23, 24:
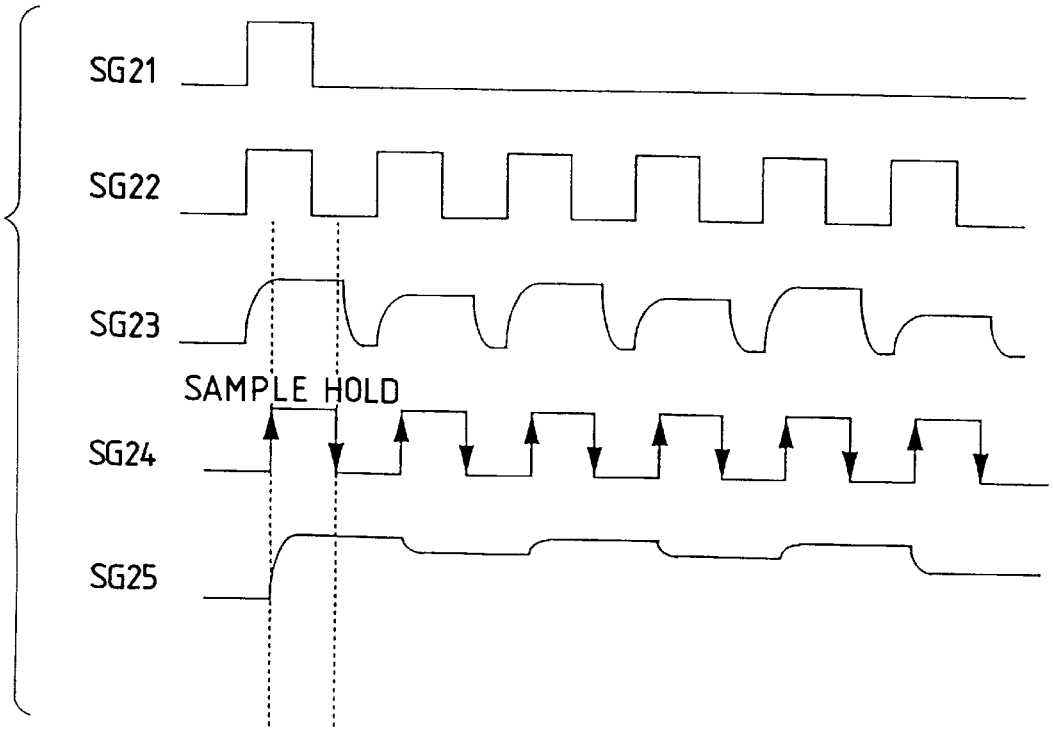
FIG. 23 is a chart showing the image signal for each row on a panel in an example 7.
FIG. 24 shows exemplary timing charts.

Herein, in order to explain the role of a fine regulation switch for the memory reading position 35 in FIG. 21, the memory output signal and the signal to be written into the pixel of liquid crystal panel are considered. FIG. 24 represents each signal of the memory unit in FIG. 21. SG21 is a memory reading start pulse, and SG22 is a reading clock.

SG23 is a memory output before the sample and hold. SG24 is a sample and hold pulse for sampling SG23 when rising and holding it when falling. SG25 is an output signal after the sample and hold.

Figure 25:
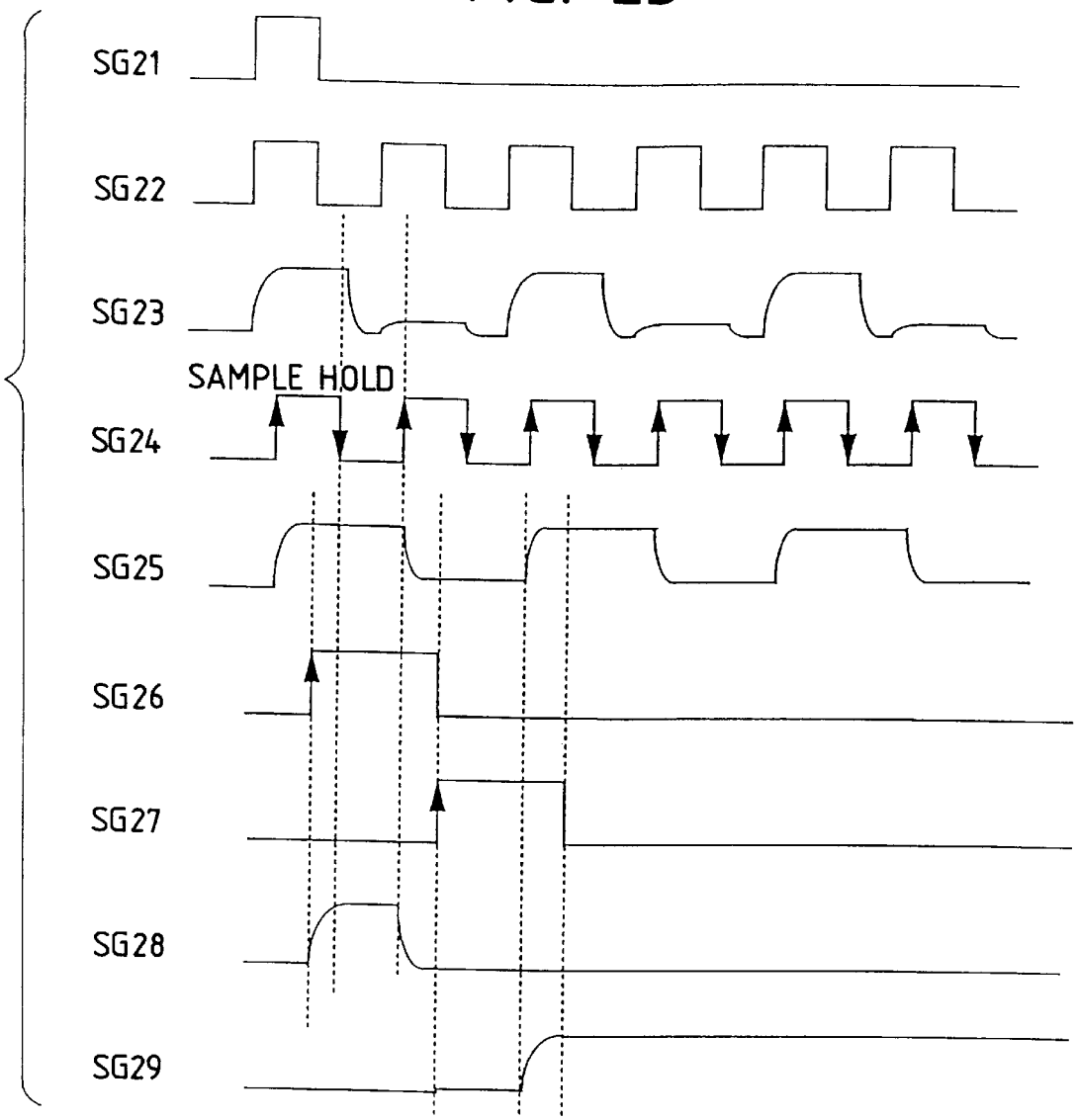
FIG. 25 shows exemplary timing charts.

In this way, the signal read from the memory is input via an inversion control amplifier into a video signal input terminal for the liquid crystal panel 14 in FIG. 14B, and by applying a sequential voltage to the gate of a vertical signal line select transistor 17 by means of a horizontal shift register 7, the liquid crystal of pixel selected in a thin film transistor 10 and the holding capacitor are charged sequentially. The behavior of charging at this time is shown in FIG. 25. SG26 and SG27 are gate voltages for the vertical signal line select transistors 17 adjacent to each other, SG28, SG29 are the potential change in the liquid crystal and the holding capacitor of adjacent pixels connected to respective vertical signal lines and selected by corresponding thin film transistor 10.

However, because each bit output from the memory of SG25 and the vertical signal select signal of SG26, SG27 are out of phase in the example of FIG. 15, the select period extends over the next bit. Therefore, the charging potential of pixel becomes a potential determined by the next bit in the final select period, though the intrinsic bits are charged. As a result, the intrinsic signal is not displayed on the liquid crystal panel. In particular, where the delay time of select panel or the delay time of signal is different depending on the liquid crystal panel, it is necessary to adjust the memory output to the optimal phase relation if the same memory is utilized.

Figure 26:
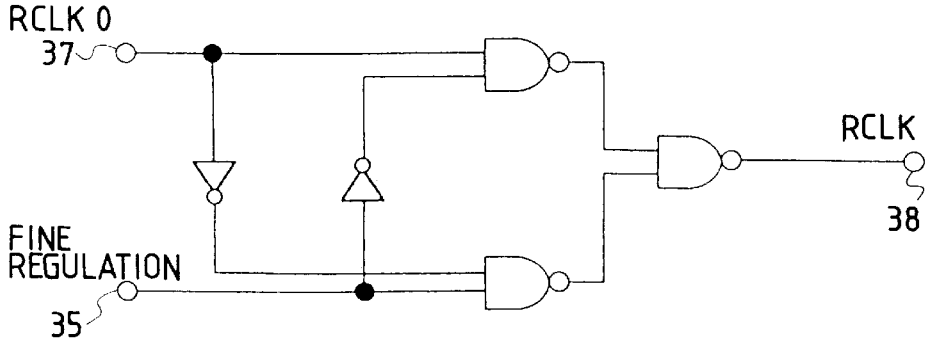
FIG. 26 shows an example of a circuit for phasing image signal.
Figure 27:
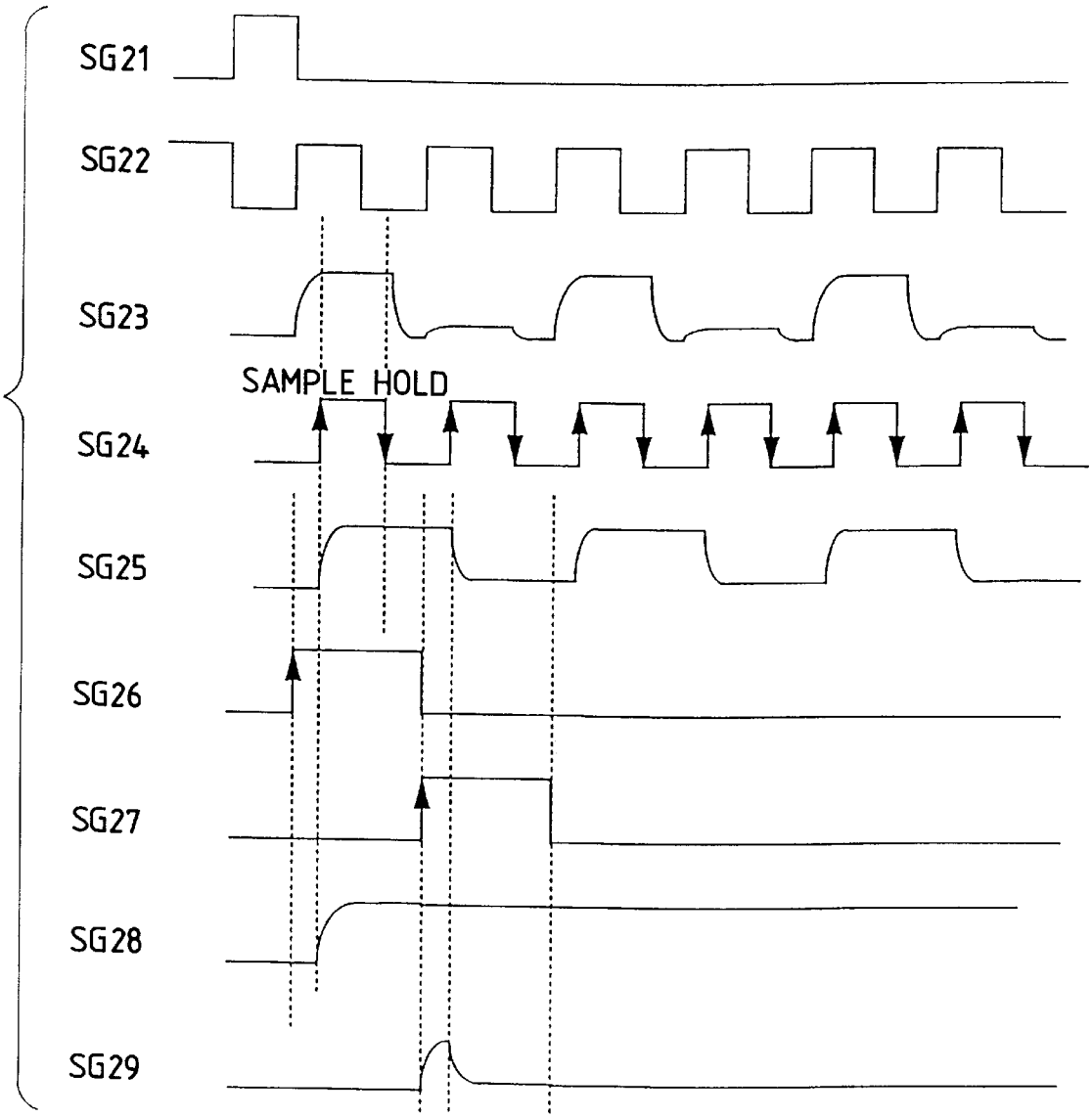
FIG. 27 shows exemplary timing charts.

Herein, as an example, using a circuit as shown in FIG. 26, the memory reading clock is shifted by one-half phase with respect to the memory start pulse in accordance with the switch control at 35 in FIG. 21. The memory reading clock (R CLK) inputted from a terminal 24 is applied to terminal 37. From a terminal 38, a reading clock with a phase controller is outputted. At this time, each signal and the charging potential of pixel are shown in FIG. 17. Because the memory reading clock is shifted by one-half phase with respect to the start pulse, the output of each bit from the memory SG25 and the vertical signal line select signal of SG26, SG26 are in phase with each other, so that the intrinsic signal is charged in the liquid crystal pixel. Of course, by providing the terminal for fine regulation at 35 with more bits, the finer phase regulation is enabled, resulting in extended utilization of memory and better image quality.

And by vertical scan altering means as previously described, the image signal of various standards can be displayed.

EXAMPLE 8

Figure 29:
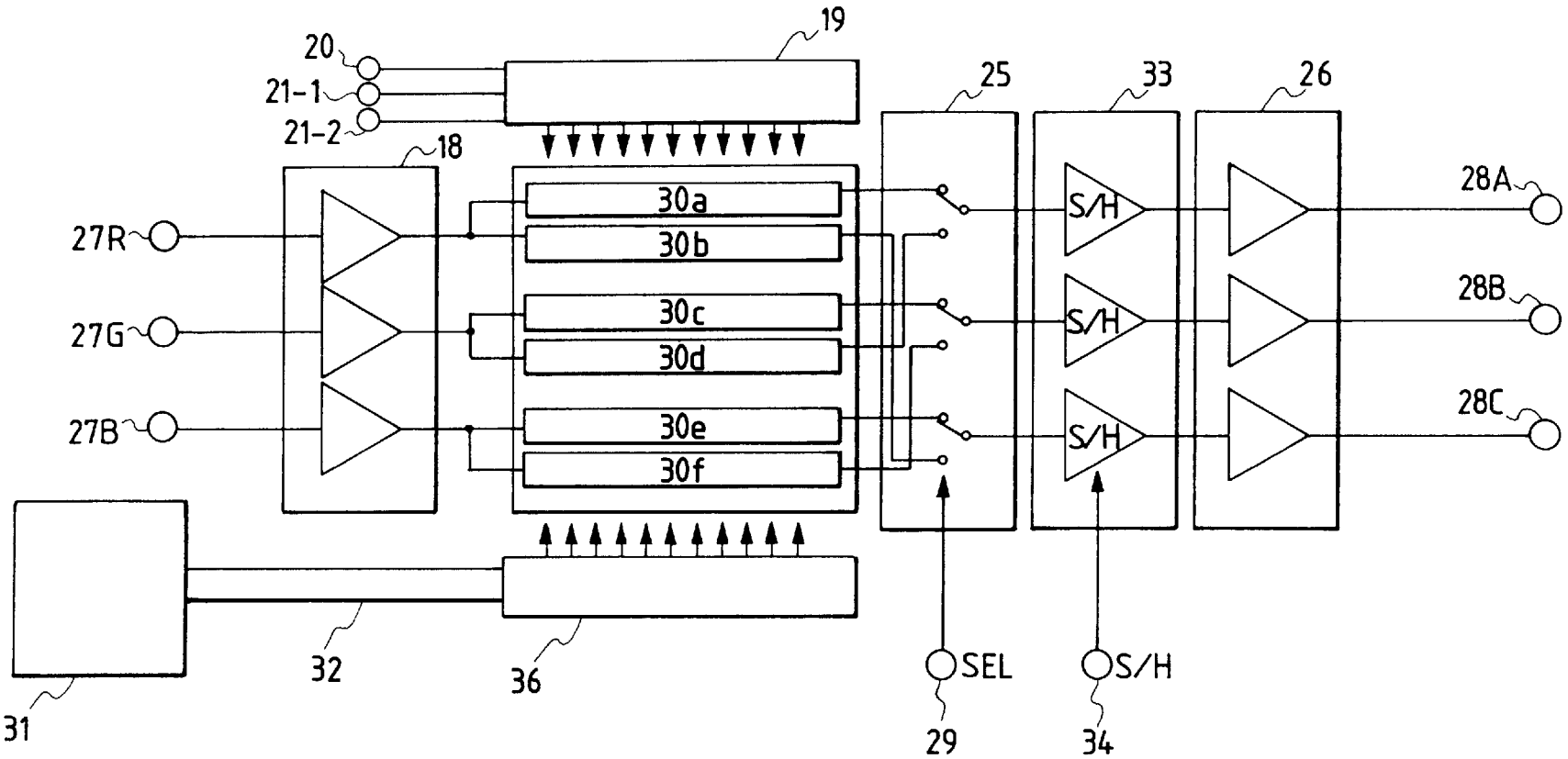
FIG. 29 is a block diagram of an analog line memory.

FIG. 29 shows a block diagram of an analog line memory unit for implementing the serial IN–serial OUT equipped with a writing shift register and a reading X-directional scan decoder as the example 8. The overall system has the same configuration as shown in FIG. 14A. In FIG. 29, 18 is an input stage of the memory unit, 19 is a memory writing shift register (WSR), 20 is a WSR start pulse (WST), 21-1, 21-2 are WSR two-phase clock pulses (WCLK1, WCLK2), 36 is a memory reading decoder (RDECO), 31 is a control unit for controlling the decoder, and 32 is a path through which the control signal is transferred from the control unit. 25 is a switching control unit for switching the signal to be sent to the video line in accordance with the color array for the liquid crystal panel. 26 is an output stage of the memory unit. 27R, 27G, 27B are input terminals for RGB signals, respectively, 28A, 28B, 28C are output terminals for outputting data through the switching by switches at 25 between the even row and the odd row of the liquid crystal screen for writing R and G, G and B, B and R, in which 29 is an input terminal of the switching control signal. 30*a* to 30*f* are memory arrays for the even row and the odd row of the liquid crystal screen for each color of RGB.

Figure 30:
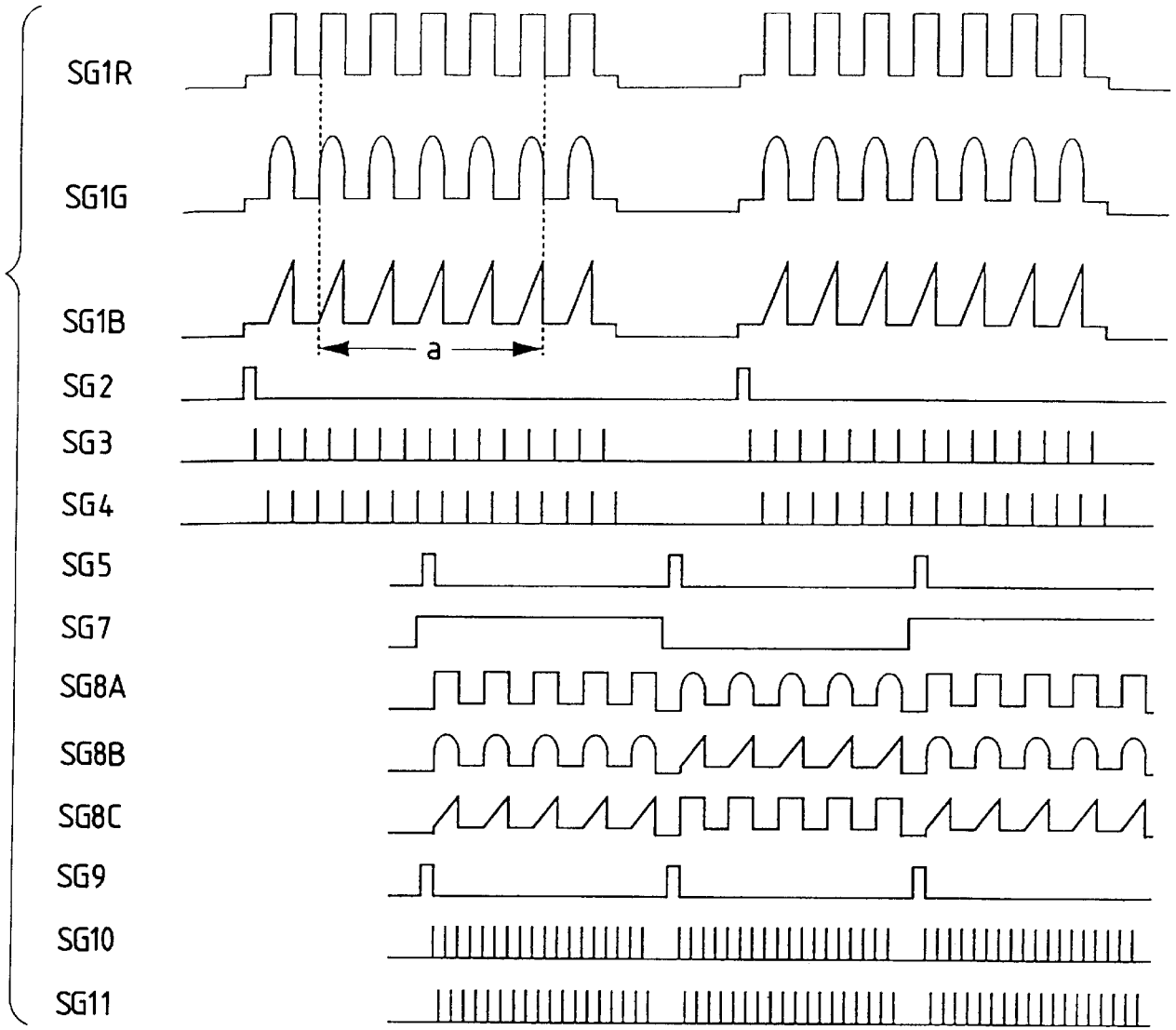
FIG. 30 shows exemplary timing charts.

FIG. 30 shows the liquid crystal and memory driving timing in the horizontal scan period in this example. SG1R is a red image signal, SG1G is a green image signal, SG1B is a blue image signal, SG2 is WST, SG3 is WCLK1, SG4 is WCLK2, SG7 is a color select switching signal, SG8A to C are signals converted into the line sequential scan signal which is output from the memory unit in accordance with the control signal of decoder, wherein by reading a part ("a" portion) of the signal in the horizontal scan period stored in the memory, the screen is enlarged in the horizontal direction. SG9 is HST, SG10 is H1, and SG11 is H2. Herein, the X decoder control pulse is omitted.

FIGS. 31A and 31B show typical views in which FIG. 31A is an original image and FIG. 31B is an image realized by this example.

As in this example, by changing the order of memory reading means and memory writing means, or using a line memory having a constitution of changing the operation frequency or start position of the shift register, the special image display such as enlargement or reduction of the screen, left and right inversion of screen, screen movement, in the horizontal direction, can be realized even with the system of line memory at low cost and with simple constitution.

And the image signal of various standards can be displayed by vertical scan altering means as previously described.

EXAMPLE 9

An example 9 is one in which the present invention is applied to an electron beam flat display. The display is a flat panel in which each pixel has an electron source and a fluorescent screen which is excited for radiation by electrons outgoing from the electron source. FIG. 9 represents simply its electron beam flat display. In the figure, 105 is a rear plate, 106 is a screen, 107 is a face plate, which constitutes an airtight container, thereby maintaining the interior of the container in vacuum. 101 is a substrate, 102 is an electron beam, 103 is a wiring in the row direction, 104 is a wiring in the column direction, which are secured to the rear plate 105. 108 is a fluorescent body, and 109 is a metal back, which are secured to the face plate 107. The electron source 102 excites the fluorescent body 108 for radiation by causing electrons to impinge against the fluorescent body 108. The fluorescent body is disposed which can emit three primary colors of red, blue and green. The metal back 109 secularly reflects back the light which the fluorescent body 108 emits to enhance the light utilization efficiency, thereby protecting the fluorescent body 108 from the electron impingement, and fulfilling a role of accelerating electrons by high voltage from a high voltage input terminal Hv. The electron source 102 is composed of M sources longitudinally arranged and N sources transversely arranged, and a total of M×N sources, which are connected through M wirings 103 in the low direction and N wirings 104 in the column direction, these wirings being orthogonal to one another. Dx1, Dx2, . . . DxM are input ends for the wirings in the row direction, and Dy1, Dy2, . . . DyN are input ends for the wirings in the column direction. The wirings 103 in the row direction are data wirings, and the wirings in the column direction 104 are scan wirings.

With such an electron beam flat display, the image signal of standards can be displayed by using vertical scan altering means as previously described.

In this example, the image signal of various standards is inversely input to the panel, while the distortion of image can be reduced to the utmost.

What is claimed is:

1. A display comprising:

a display panel having a plurality of pixels arranged in a matrix having m rows; and a driving circuit for writing on said m rows an image signal one field of which is constituted by horizontal scanning k times, where $k \neq m$ and $k \neq m/2$, while sequentially selecting the row, and for writing, into plural rows, a signal sampled from image signals corresponding to an arbitrary horizontal scan among the k horizontal scans, so that plural signals sampled in different timings written in adjacent rows have polarities opposite to each other, with a reversed order of writing.

2. A display according to claim 1, wherein said driving circuit comprises a first switch group connecting to a first control line, a second switch group connecting to a second control line, and a third switch group connecting to a third control line.

3. A display according to claim 1 or 2, wherein said driving circuit writes an image signal corresponding to an arbitrary n-th, where $n \leqq k$, horizontal scan among said k times in any row of said m rows.

4. A display according to claim 1, wherein said plurality of pixels are arranged in a delta configuration, and said driving circuit normally writes an image signal corresponding to one horizontal scan in two rows, among said k times, and, only at every arbitrary n-th horizontal scan, where $n \leqq k$, writes an image signal corresponding to said n-th horizontal scan in any one row of said m rows.

5. A display according to claim 1, wherein said plurality of pixels are arranged in aligned configuration, and said driving circuit writes an image signal corresponding to said one horizontal scan in two rows, by two-row interpolation driving.

6. A display according to claim 1, wherein said driving circuit writes an image signal corresponding to said one horizontal scan in two rows by two-row simultaneous driving.

7. A display according to claim 1, wherein the image signal constituting one field with said k horizontal scans is of the PAL system.

8. A display according to claim 1, wherein k is from 250 to 313.

9. A display according to claim 1, wherein said panel normally displays an image signal of the NTSC system.

10. A display according to claim 1, wherein the image signal constituting one frame with said m horizontal scans is of the NTSC system.

11. A display according to claim 1, wherein m is from 480 to 525.

12. A display according to claim 3, wherein n is from 2 to 8.

13. A display according to claim 3, wherein n is from 3 to 4.

14. A display according to claim 3, wherein n alternates between 3 and 4 within one field.

15. A display according to claim 1, wherein said driving circuit comprises a bootstrap scan circuit.

16. A display according to claim 1, wherein said panel comprises a pair of substrates, and liquid crystal material to constitute a liquid crystal panel.

17. A display according to claim 16, wherein said liquid crystal panel has a switching element for every pixel.

18. A display according to claim 17, wherein said switching element is TFT.

19. A display according to claim 1, further comprising a fluorescent body and an electron source for every pixel.

20. A driving method for a display including a display panel having a plurality of pixels arranged in a matrix having m rows and a driving circuit, said method comprising:

writing, by the driving circuit, on the m rows an image signal one field of which is constituted by horizontal scanning k times, where $k \neq m$ and $k \neq m/2$, while sequentially selecting the row; and writing, by the driving circuit, into plural rows, a signal sampled from image signals corresponding to an arbitrary horizontal scan among the k horizontal scans, so that signals written in adjacent rows and sampled in different timings have polarities opposite to each other, with a reversed order of writing.

21. A driving method for a display according to claim 20, wherein the driving circuit comprises a first switch group connecting to a first control line, a second switch group connecting to a second control line, and a third switch group connecting to a third control line.

22. A driving method for a display according to claim 20 or 21, wherein the driving circuit writes an image signal corresponding to an arbitrary n-th, where $n \leqq k$, horizontal scan among the k times in any row of the m rows.

23. A driving method for a display according to claim 20, wherein the plurality of pixels are arranged in a delta configuration, and the driving circuit normally writes an image signal corresponding to one horizontal scan in two rows, among the k times, and only at every arbitrary n-th horizontal scan, where $n \leqq k$, writes an image signal corresponding to the n-th horizontal scan in any one row of the m rows.

24. A driving method for a display according to claim 20, wherein the plurality of pixels are arranged in aligned configuration, and the driving circuit writes an image signal corresponding to the one horizontal scan in two rows, by two-row interpolation driving.

25. A driving method for a display according to claim 20, wherein the driving circuit writes an image signal corresponding to the one horizontal scan in two rows by two-row simultaneous driving.

26. A driving method for a display according to claim 20, wherein the image signal constituting one field with k horizontal scans is of the PAL system.

27. A driving method for a display according to claim 20, wherein k is from 250 to 313.

28. A driving method for a display according to claim 20, wherein the panel normally displays an image signal of the NTSC system.

29. A driving method for a display according to claim 20, wherein the image signal constituting one frame with the m horizontal scans is of the NTSC system.

30. A driving method for a display according to claim 20, wherein m is from 480 to 525.

31. A driving method for a display according to claim 22, wherein n is from 2 to 8.

32. A driving method for a display according to claim 22, wherein n is from 3 to 4.

33. A driving method for a display according to claim 22, wherein n alternates between 3 and 4 within one field.

34. A driving method for a display according to claim 20, wherein the driving circuit comprises a bootstrap scan circuit.

35. A driving method for a display according to claim 20, wherein the panel comprises a pair of substrates, and liquid crystal material to constitute a liquid crystal panel.

36. A driving method for a display according to claim 35, wherein the liquid crystal panel has a switching element for every pixel.

37. A driving method for a display according to claim 36, wherein the switching element is a TFT.

38. A driving method for a display according to claim 20, comprising a fluorescent body and an electron source for every pixel.

39. A method of driving a color display panel having pixels arranged in m rows and n columns in an RGB color coded delta formation, to display an image represented by an image signal determined for k effective raster scan lines for each odd and even image field, which method includes normal mode operation steps or performing two-row interpolation driving whereby writing of image line data obtained from said image signal is enabled line sequentially, and in-phase and anti-phase sample image line data, for a corresponding image scan line are written on respective ones of two consecutive matrix rows during each horizontal scan period in an alternating order, the polarities of the line data written to each matrix row alternating from one matrix row to the next matrix row or from one pair of matrix rows to the next pair of matrix rows;

characterized in that:

to display an image where the number k of scan lines is different from m and different from m/2, and has a value therebetween, said method is modified by compression mode operation steps which all are performed repeatedly after respective numbers of horizontal scan periods, said compression mode operation steps consisting of:

interrupting said two-row interpolation driving following the writing of the first one of said in-phase or anti-phase sample image line data to the first of the two consecutive matrix row written in the following horizontal scan period;

suppressing the writing of the second one of said in-phase or anti-phase sample image line data that would be written to the second of said two consecutive matrix rows; and resuming said two-row interpolation driving for the next following horizontal scan period starting with writing to said second of said two consecutive rows, in which the alternating order of writing said in-phase and anti-phase sample image line data is reversed and the sequence of alternating polarity of the written image signals is maintained without disruption.

40. A method according to claim 39, wherein said in-phase and anti-phase sample image line data are written with one and the opposite polarity in each odd field and the inverse of said one and the opposite polarity in each even field.

41. A method according to claim 39, wherein, during said two-row interpolation driving, siad in-phase and anti-phase sample image line data are written with polarities that are inverted for each alternate horizontal scan period, which in-phase and anti-phase sample image line data written in respective horizontal scan periods have the respective same polarity when written in said alternating order and have respective opposite polarity when written in the reversed alternating order.

42. A method according to any of claims 39 applied to an active matrix liquid crystal color display panel.

43. A method according to claim 39 applied to an electron-emitting color display panel comprising a color-coded fluorescent body and an electron source, having an electron-emitting device for each of said pixels, arranged opposite to said fluorescent body.

44. A color display apparatus, operable according to the method of claim 39 comprising:

a color display panel having pixels arranged in m rows and n columns in an RGB color coded delta formation, to display an image represented by an image signal having k effective raster scan lines for each odd and even image field; and driving means for driving said display panel in a two-row interpolation manner, said driving means including:

writing means for writing paired in-phase and anti-phase sample image line data, each pair corresponding to respective scan lines of the image represented by the image signal, on respective pairs of first and second consecutive matrix rows, the polarities of the line data to be written to each matrix row alternating from one matrix row to the next matrix row or from one pair of consecutive matrix rows to the next pair of consecutive matrix rows;

selecting means for selecting said matrix rows line sequentially for writing said line data, two-consecutive matrix rows at consecutive times in each horizontal scan period; and control means arranged to control said writing means and said selecting means, to control the relative timing and sequence of the operation thereof;

characterized in that:

to display an image where the number k of scan lines is different from n and different from m/2, and has a value therebetween, said driving means is adapted to perform said compression mode operation steps and thus includes:

means of interrupting two-row interpolation driving;

means of suppressing said writing of the second one of in-phase and anti-phase sample image line data; and means of resuming said two-row interpolation driving

45. An apparatus according to claim 44, wherein said selection means includes:

a first array of switches connected between odd matrix rows of the display panel and a first control line for inputting a first scan voltage signal;

a second array of switches connected between even matrix rows of the display panel and a second control line for inputting a second scan voltage signal;

a third array of switches connected between the third and subsequent odd matrix rows of the display panel and a third control line for inputting a third scan voltage signal, and a gating signal generating means for generating respective sequential gating signals and supplying each to a respective group of three switches, one switch in each first, second and third array;

said control means supplies said first to third scan voltage signals which signals gated by said switches of said first and second arrays are to enable two-row interpolation driving in said alternating order, which signals gated by said switches of said second and third arrays are to enable twp-row interpolation driving in said reverse alternating order, and which signals respectively gated by said switches of said second and third arrays are to suppress writing following interruption of said two-row interpolation driving in said alternating order and in said reverse alternating order, respectively; and said control means is arranged to control said gating signal generating means to generate and supply modified gating signals to facilitate writing, starting from the second of two consecutive rows, each time two-row interpolation driving is resumed.

46. An apparatus according to claim 45, wherein said writing means includes respective line memories for storing the in-phase and anti-phase sample image line data that is to be used in writing to the display panel.

47. An apparatus according to claim 44, wherein said color display panel is an active matrix liquid crystal display panel.

48. An apparatus according to claim 45, wherein said color display panel is an electron-emitting color display panel comprising a color-coded fluorescent body and an electron source having an electron-emitting device for each of said pixels, arranged opposite to said fluorescent body.

* * * * *

UNITED STATES PATENT AND TRADEMARK OFFICE

CERTIFICATE OF CORRECTION

PATENT NO. : 6,072,457

DATED : June 6, 2000

INVENTOR(S) : SEIJI HASHIMOTO ET AL.

It is certified that error appears in the above-identified patent and that said Letters Patent is hereby corrected as shown below:

ON THE TITLE PAGE [56] References Cited:

FOREIGN PATENT DOCUMENTS,

| | | |
|---|---|---|
| "2182087 | should read | --2-182087 |
| 537909 | | 5-37909 |
| 5100641 | | 5-100641 |
| 5236435" | | 5-236435--. |

COLUMN 1:

Line 61, "detail" should read --detailed--.

COLUMN 2:

Line 52, "Beside," should read --Besides,--.

COLUMN 4:

Line 18, "maybe" should read --may be-- and "signals" should read --signals of--;
Line 59, "signal" should read --signals--; and
Line 60, "signal" should read --signals--.

COLUMN 5:

Line 1, "detail" should read --detailed--;
Line 24, "detail" should read --detailed--; and
Line 53, "detail" should read --detailed--.

UNITED STATES PATENT AND TRADEMARK OFFICE

CERTIFICATE OF CORRECTION

PATENT NO. : 6,072,457

DATED : June 6, 2000

INVENTOR(S) : SEIJI HASHIMOTO ET AL.

It is certified that error appears in the above-identified patent and that said Letters Patent is hereby corrected as shown below:

COLUMN 6:

Line 11, "detail" should read --detailed--.

COLUMN 7:

Line 20, "id" should read --is--.

COLUMN 9:

Line 28, "is" should read --are--; and
Line 40, "curcuits" should read --circuit--

COLUMN 14:

Line 14, "indicates" should read --indicate--;
Line 16, "represents" should read --represent--;
Line 18, "is" should read --are--; and
Line 41, "is" should read --are--.

COLUMN 15:

Line 57, "as" should read --as in--.

COLUMN 19:

Line 60, "siad" should read --said--.

UNITED STATES PATENT AND TRADEMARK OFFICE

CERTIFICATE OF CORRECTION

PATENT NO. : 6,072,457

DATED : June 6, 2000

INVENTOR(S) : SEIJI HASHIMOTO ET AL.

It is certified that error appears in the above-identified patent and that said Letters Patent is hereby corrected as shown below:

COLUMN 20:

Line 43, "driving" should read --driving.--; and
Line 66, "twp-row" should read --two-row--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*